US012359874B2

(12) United States Patent
Yang et al.

(10) Patent No.: US 12,359,874 B2
(45) Date of Patent: Jul. 15, 2025

(54) MULTIPLE MODE HYBRID HEAT EXCHANGER

(71) Applicant: SPX Cooling Technologies, Inc., Overland Park, KS (US)

(72) Inventors: Jidong Yang, Overland Park, KS (US); Zan Liu, Overland Park, KS (US); Kathryn Pullen, Overland Park, KS (US)

(73) Assignee: SPX Cooling Technologies, Inc., Overland Park, KS (US)

( * ) Notice: Subject to any disclaimer, the term of this patent is extended or adjusted under 35 U.S.C. 154(b) by 455 days.

(21) Appl. No.: 17/701,090

(22) Filed: Mar. 22, 2022

(65) Prior Publication Data

US 2022/0299269 A1 Sep. 22, 2022

Related U.S. Application Data

(60) Provisional application No. 63/164,228, filed on Mar. 22, 2021.

(51) Int. Cl.
*F28C 1/14* (2006.01)
*F28D 3/02* (2006.01)
(Continued)

(52) U.S. Cl.
CPC ..... *F28C 1/14* (2013.01); *F28D 3/02* (2013.01); *F28F 25/06* (2013.01); *F28F 27/003* (2013.01);
(Continued)

(58) Field of Classification Search
CPC ..... F28C 1/14; F28D 3/02; F28F 25/06; F28F 27/003; F28F 2025/005; F28F 2250/08
See application file for complete search history.

(56) References Cited

U.S. PATENT DOCUMENTS 5,390,502 A * 2/1995 Storbeck ..... F28D 5/02 261/DIG. 11
5,435,382 A * 7/1995 Carter ..... F28D 5/02 261/153
(Continued)

FOREIGN PATENT DOCUMENTS

CN 105202941 A * 12/2015
CN 105202941 B 3/2018
FR 2270539 A2 12/1975

OTHER PUBLICATIONS

Machine translation of CN 105202941 (Year: 2024).*
(Continued)

*Primary Examiner* — Eric S Ruppert
*Assistant Examiner* — Hans R Weiland
(74) *Attorney, Agent, or Firm* — Husch Blackwell LLP

(57) ABSTRACT

A multiple mode hybrid heat exchanger apparatus is disclosed. The heat exchange apparatus includes a frame assembly having a first end wall, a second end wall, a first side wall, a second side wall, an indirect heat exchange section, a spray system, an intermediate distribution basin, and a direct heat exchange section. A vertical passage is defined by the frame assembly and the direct heat exchange section. A lower air inlet is defined by a plurality of openings in the direct heat exchange section, and the lower air inlet is configured to provide an inlet for air into the vertical passage. The apparatus further includes a cold water collection basin and a fan to induce an airflow through the lower air inlet. The multiple mode hybrid heat exchanger apparatus is selectably configured to operate in an evaporative mode, a dry mode, and an adiabatic mode.

21 Claims, 21 Drawing Sheets

(51) Int. Cl.

| | |
|---|---|
| ***F28F 25/06*** | (2006.01) |
| ***F28F 27/00*** | (2006.01) |
| *F28F 25/00* | (2006.01) |

(52) U.S. Cl.
CPC ..... *F28F 2025/005* (2013.01); *F28F 2250/08* (2013.01)

(56) References Cited

U.S. PATENT DOCUMENTS

| | | | | |
|---|---|---|---|---|
| 5,816,318 | A | 10/1998 | Carter | |
| 6,142,219 | A | 11/2000 | Korenic et al. | |
| 6,213,200 | B1 | 4/2001 | Carter et al. | |
| 7,107,782 | B2 * | 9/2006 | Carter | F28D 5/02 62/305 |
| 7,310,958 | B2 * | 12/2007 | Carter | F28D 5/02 62/171 |
| 7,887,030 | B2 * | 2/2011 | Hentschel | F28C 1/04 261/DIG. 11 |
| 11,287,191 | B2 * | 3/2022 | Aaron | F28C 1/14 |
| 2009/0283245 | A1 | 11/2009 | Hentschel et al. | |
| 2014/0264973 | A1 | 9/2014 | Aaron et al. | |

OTHER PUBLICATIONS

International Search Report and Written Opinion issued for International Application No. PCT/US2022/021323 dated Jun. 22, 2022, 10 pages.
Extended European Search Report for European Patent Application No. 22776456.0 issued on Dec. 18, 2024, 10 pages.

* cited by examiner

MULTIPLE MODE HYBRID HEAT EXCHANGER

CROSS-REFERENCE TO RELATED APPLICATION

This application claims priority to U.S. Provisional Application No. 63/164,228, filed Mar. 22, 2021, titled MULTIPLE MODE HYBRID HEAT EXCHANGER, the disclosure of which is hereby incorporated in its entirety.

FIELD OF THE INVENTION

The present invention relates to a heat exchanger to cool and/or condense a heat exchange fluid. More particularly, the present invention relates to heat exchanger selectively configured to cool and/or condense a heat exchange fluid in an evaporative "wet" mode, dry mode, or adiabatic mode.

BACKGROUND OF THE INVENTION

Closed circuit heat exchangers are widely used in many applications where it is necessary to cool or condense a heat transfer fluid (liquid and/or gas). While heat exchange is generally well understood, a number of different principles may be utilized in convention heat exchangers. However, a heat exchanger optimized to work well in one set of conditions may fail to operate well at another set of conditions.

The general principle of the evaporative heat exchange process involves the fluid or gas from which heat is to be extracted flowing through tubes or conduits having an exterior surface that is continuously wetted with an evaporative liquid, usually water. Air is circulated over the wet tubes to promote evaporation of the water and the heat of vaporization necessary for evaporation of the water is supplied from the fluid or gas within the tubes resulting in heat extraction. The portion of the cooling water which is not evaporated is recirculated and losses of fluid due to evaporation are replenished.

Conventional evaporative heat exchangers are presently in widespread use in such areas as factory complexes, chemical processing plants, hospitals, apartment and/or condominium complexes, warehouses and electric generating stations. These heat exchangers usually include an upwardly extending frame structure supporting an array of tubes which form a coil assembly. An air passage is formed by the support structure within which the coil assembly is disposed. A spray section is provided usually above the coil assembly to spray water down over the individual tubes of the coil assembly. A fan is arranged to blow air into the air passage near the bottom thereof and up between the tubes in a counter flow relationship to the downwardly flowing spray water. Alternatively, fans may draw air through the heat exchanger before being discharged through the fan. Heat from the fluid or gas passing through the coil assembly tubes is transferred through the tube walls to the water sprayed over the tubes. As the flowing air contacts the spray water on the tubes, partial evaporation of some of the spray water occurs along with a transfer of heat from the spray water to the air. The air then proceeds to flow out of the heat exchanger system. The remaining unevaporated spray water collects at the bottom of the conduit and is pumped back up and out through the spray section in a recirculatory fashion.

Current practice for improving the above described heat transfer process includes increasing the surface area of the heat exchange tubes. This can be accomplished by increasing the number of coil assembly tubes employed in the evaporative heat exchanger by "packing" the tubes into a tight an array as possible, maximizing the tubular surface available for heat transfer. The tightly packed coils also increase the velocity of the air flowing between adjacent tube segments. The resulting high relative velocity between the air and water promotes evaporation and thereby enhances heat transfer.

Another practice currently employed to increase heat transfer surface area is the use of closely spaced fins which extend outwardly, in a vertical direction from the surface of the tubes. The fins are usually constructed from a heat conductive material, where they function to conduct heat from the tube surface and offer additional surface area for heat exchange.

In addition, another method currently used to increase heat exchange is the use of a direct heat exchange section in from of splash type fill structures or film type packs positioned in a vertical relationship with the coil assembly.

These current practices can have drawbacks. For example, in cold conditions, water sprayed on to the heat exchange conduits or fill media may freeze. In another example, the use of additional tubes requires additional coil plan area along with increased fan horsepower needed to move the air through the tightly packed coil assembly, increasing unit cost as well as operating cost. In addition, placement of fins between the individual tubes may make the heat exchanger more susceptible to fouling and particle build up.

Accordingly, it is desirable to provide a method and apparatus for cooling a fluid that can offer improved flexibility to function at a range of temperatures above and below the freezing point of water while improving efficiency and or without undesirably increasing the size of the unit, the manufacturing cost of the unit, and/or operating cost of the unit.

SUMMARY OF THE INVENTION

The foregoing needs are met, at least in part, by the present invention where, in one embodiment a multiple mode hybrid heat exchanger is disclosed.

In accordance with an embodiment of the present invention, a multiple mode hybrid heat exchanger apparatus includes a frame assembly, an indirect heat exchange section, a spray system, an intermediate distribution basin, a direct heat exchange section, a vertical passage, a lower air inlet, a cold water collection basin, and a fan. The frame assembly includes a first end wall, a second end wall that opposes the first end wall, a first side wall that extends between the first and second end walls, and a second side wall that opposes the first side wall that extends between the first and second end walls. The direct heat exchange section is disposed below the indirect heat exchange section. The vertical passage is defined by the frame and the direct heat exchange section. The lower air inlet is defined by a plurality of openings between a plurality of fill media sheets in the direct heat exchange section. The lower air inlet is configured to provide an inlet for air into the vertical passage. The cold water collection basin is disposed below the direct heat exchange section. The fan is to induce a flow of air through the lower air inlet. The multiple mode hybrid heat exchanger is selectably configured to operate in an evaporative mode, dry mode, and an adiabatic mode. The dry mode of operation includes deactivation of the spray system, air enters the vertical passage through the direct heat exchange section, and also airflow enters the upper air inlets and passes through the indirect heat exchange section. The adiabatic mode of operation includes the spray system is bypassed on the indirect heat exchange section, the direct heat exchange section is configured to facilitate a passage of water therethrough. The air enters the vertical passage through the direct heat exchange section, the air passing horizontally across a flow of water to directly cool the water. The water is collected in the cold water collection basin. The airflow then passes through the indirect heat exchange section.

In accordance with another embodiment of the present invention, a multiple mode hybrid heat exchanger apparatus includes a frame assembly, an indirect heat exchange section, a spray system, an intermediate distribution basin, a direct heat exchange section, a vertical passage, a second indirect heat exchange section, a lower air inlet, a cold water collection basin, and a fan. The frame assembly includes a first end wall, a second end wall that opposes the first end wall, a first side wall that extends between the first and second end walls, and a second side wall that opposes the first side wall that extends between the first and second end walls. The direct heat exchange section is disposed below the indirect heat exchange section. The vertical passage is defined by the frame and the direct heat exchange section. The second indirect heat exchange section is disposed in an upper portion of the vertical passage. The lower air inlet is defined by a plurality of openings between a plurality of fill media sheets in the direct heat exchange section. The lower air inlet is configured to provide an inlet for air into the vertical passage. The cold water collection basin is disposed below the direct heat exchange section. The fan is to induce a flow of air through the lower air inlet. The multiple mode hybrid heat exchanger is selectably configured to operate in an evaporative mode, dry mode, and an adiabatic mode. The dry mode of operation includes deactivation of the spray system, air enters the vertical passage through the direct heat exchange section, and also airflow enters the upper air inlets and passes through the indirect heat exchange section. The adiabatic mode of operation includes the spray system is bypassed on the indirect heat exchange section, the direct heat exchange section is configured to facilitate a passage of water therethrough. The air enters the vertical passage through the direct heat exchange section, the air passing horizontally across a flow of water to directly cool the water. The water is collected in the cold water collection basin. The airflow then passes through the indirect heat exchange section.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

In general, embodiments of the multiple mode hybrid heat exchanger described herein refer to a hybrid fluid cooler having crossflow film fill at the bottom and coil on the top. The recirculating water is first sprayed on the coil section. It is then collected by the collection trough and directed to hot water basins on two sides of the tower where the crossflow fill is located. There are few different ways that air flow may be directed into and through the tower. In some embodiments, air comes in from two sides through the crossflow fill. It then pass through the upper coil section. This is generally referred to as a 'one-pass flow configuration'.

In other embodiments, air flow is selectively controlled to enter the tower via the top coil section and/or bottom fill section. If air is controlled to enter via the top coil section, air enters from two side in the collection trough area. This can be referred to as a 'two-pass flow configuration'. Yet another embodiment is a variation of the two-pass flow configuration with an added section on top or below of the water collection section to allow air to enter from all four sides. In still yet another embodiment, an interior damper may control airflow to selectively bypass the primary upper coil section. As described herein, the various dampers may be open and closed to selectively operate in a wet (e.g., 'evaporative') mode, dry mode, or adiabatic mode. In some or all of the embodiments, the fill can be sloped at different angles. For example, the fill may be sloped at 12 degrees as shown in FIG. 3 compared to FIGS. 1, 2, 4, and 4 in which the fill is sloped at 5.5 degree. Optional dampers may be added at the upper air inlet section in FIGS. 2-4, 6-12, and 14-20. This helps to achieve the optimal air split ratio during different mode of operation. For example, dampers at the upper inlet section can be closed during the adiabatic mode to pre-cool of the ambient air. An optional secondary indirect finned heat exchange may also be included as shown in FIGS. 4 and 14-20. If included, the optional secondary indirect finned heat exchange may improve dry mode performance, for example. A supply of heat transfer fluid (e.g., water as liquid or vapor) is provided to the multiple mode hybrid heat exchanger by supply piping, removed by outlet piping, and controlled via a pump and a plurality of valves.

Figure 1:
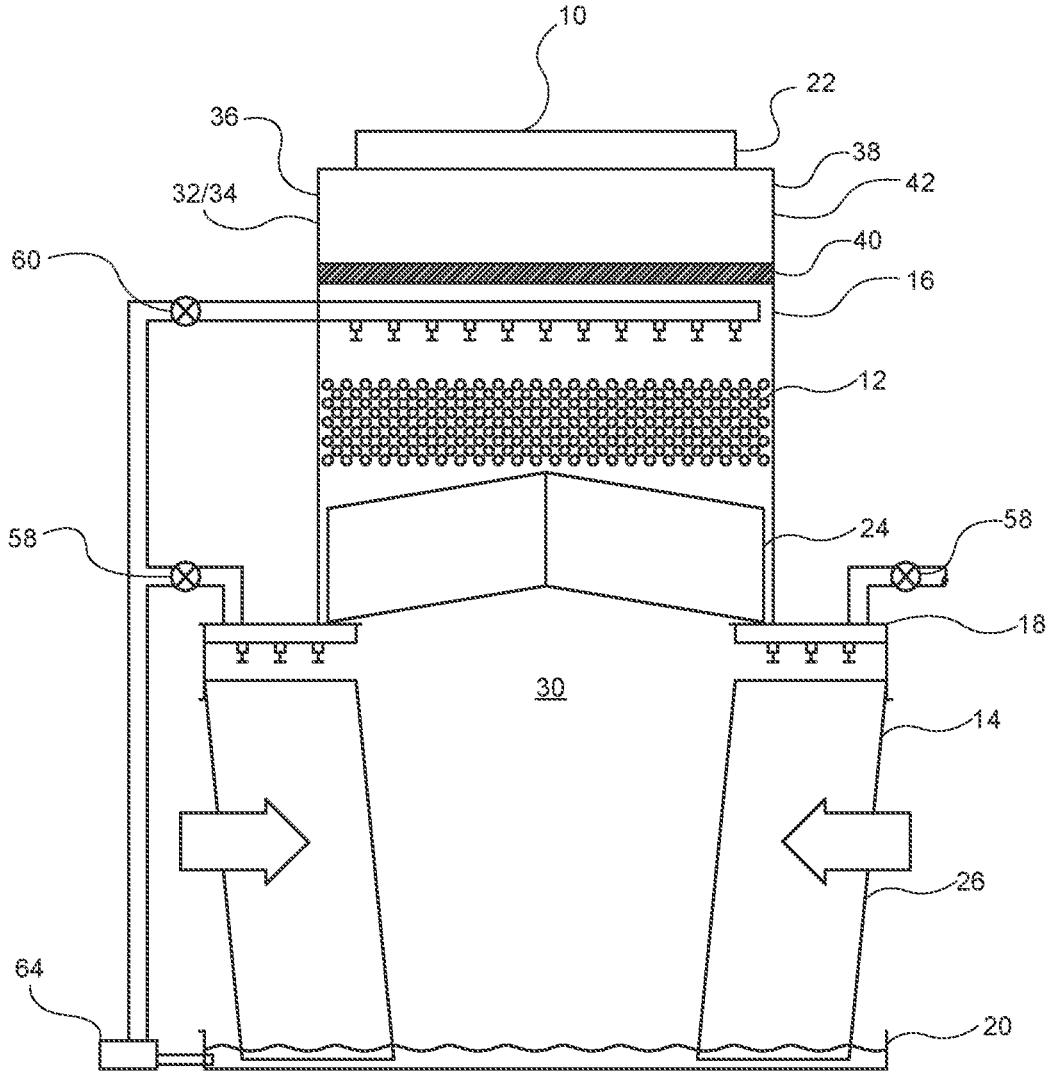
FIG. 1 is a cutaway view through the side of a multiple mode hybrid heat exchanger employing an indirect heat exchange section and direct heat exchange section in accordance with an embodiment of the present invention.

Referring now to FIG. 1 of the drawings, a multiple mode hybrid heat exchanger, generally designated 10, is illustrated in accordance with an embodiment of the present invention. Generally, the multiple mode hybrid heat exchanger 10 includes a tower frame or structure having a primary indirect heat exchange ("HE") section 12, an optional secondary indirect HE section, and a direct HE section 14. The primary indirect HE section 12 includes any suitable heat exchanger. Examples of heat exchangers suitable for use as the primary indirect HE section 12 include: various plate style heat exchangers; various coil type heat exchangers such as a serpentine, single or multi-circuit coil indirect heat exchange for evaporative fluid cooling or condensing; and the like. The direct HE section 14 includes a fill media such as polymer film sheets to increase the wetted surface area and cool the water via the air flowing through the wet fill media. The multiple mode hybrid heat exchanger 10 includes a cooling liquid distribution assembly or spray system 16, one or more hot water collection basins 18, and a cold water collection basin 20. The multiple mode hybrid heat exchanger 10 also includes a fan 22 that moves or generates a stream or current of air into the multiple mode hybrid heat exchanger 10 via one or more lower air inlets 26. The fan 22 may include more than one fan and the size may vary depending upon multiple mode hybrid heat exchanger 10 size and application.

The spray system 16 is configured to supply a spray of water to the primary indirect HE section 12. The water moves down through the coils in the primary indirect HE section 12 as the air is drawn up by the fan 22. A water collector 24 collects the water that flows down from the primary indirect HE section 12 and deposits the collected water into the one or more hot water basins 18. The water collector 24 is shown in greater detail in FIG. 5.

The multiple mode hybrid heat exchanger 10 is generally rectilinear in geometry having an interior space or vertical passage 30 that is of generally rectangular, uniform cross-section. The vertical passage 30 is defined by vertical front, rear walls 32, 34 and vertical side walls 36, 38, and the direct HE sections 14. The walls 32, 34, 36, and 38, extend upwardly from the basin. The side walls 32, 34 and front and rear walls 36, 38 combine to form the interior 30 within which the air passage, the hot water basin or gravity-flow intermediate basin 18, the primary indirect heat exchange assembly 12, the optional secondary indirect heat exchange assembly 46, and the direct heat exchange assembly 14 are located. The walls 32, 34, 36, and 38 provide structure, facilitate air flowing through the indirect and direct HE sections 12/14/46, and facilitate the containment of water within the multiple mode hybrid heat exchanger 10. To further limit the loss of water, the multiple mode hybrid heat exchanger 10 may, optionally, include a drift eliminator 40 disposed before an outlet from the multiple mode hybrid heat exchanger 10. In a particular example, the drift eliminator may be disposed between the spray system 16 and the fan 22. The fan 22 is preferably positioned on the top of the multiple mode hybrid heat exchanger 10 and a plenum 42 is defined by the volume between the fan 22, the drift eliminator 40, and the walls 32, 34, 36, and 38.

The walls and other structural elements that form the interior 30 and framing structure of the multiple mode hybrid heat exchanger 10 are preferably formed from mill galvanized steel, but may be composed of other suitable materials such as stainless steel, hot dipped galvanized steel, epoxy coated steel, and/or fiber reinforced plastics (FRP).

The multiple mode hybrid heat exchanger 10 is configured to be selectable between a "evaporative mode", a "dry mode", and an "adiabatic mode" of operation. Depending upon the ambient temperature and humidity, and the system heat load, the three operation modes can achieve energy or water consumption saving. It can also avoid otherwise undesirable affects for example such as the spray water in the multiple mode hybrid heat exchanger 10 may freeze. In such conditions, the multiple mode hybrid heat exchanger 10 is advantageously configured to be operated in the "dry mode". In "dry mode", the spray system 16 is deactivated and the basins 18 and 20 may be drained of water.

Compared to all other indirect and direct hybrid evaporative cooling apparatus, the multiple mode hybrid heat exchanger 10 is configured to improve "dry mode" or "winter mode" operations by facilitating airflow up through the vertical passage 30. That is, by disposing two fill packs, one each to a side of the direct HE section 14, a greater volume of airflow may enter the vertical passage 30 in comparison to cooling towers with less airflow. With FIG. 1-4, all of the air stream passes through the primary indirect HE section (in all three modes), regardless whether it is one-pass flow configuration or two-pass flow configuration. No other hybrid indirect/direct products have this design.

In adiabatic mode, the spray system 16 is activated. The water may bypass the primary indirect HE section 12. Instead, by using the valve combinations (FIG. 13-14), the spray water is directed to the hot water basin which in turn cascades over and then through the direct HE section 14.

The multiple mode hybrid heat exchanger 10 shown in FIGS. 2-4, 6-12, and 14-20 is similar to the multiple mode hybrid heat exchanger 10 shown in FIG. 1 and thus, for the sake of brevity, those elements already described with reference to FIG. 1, may not be described again.

Figure 2:
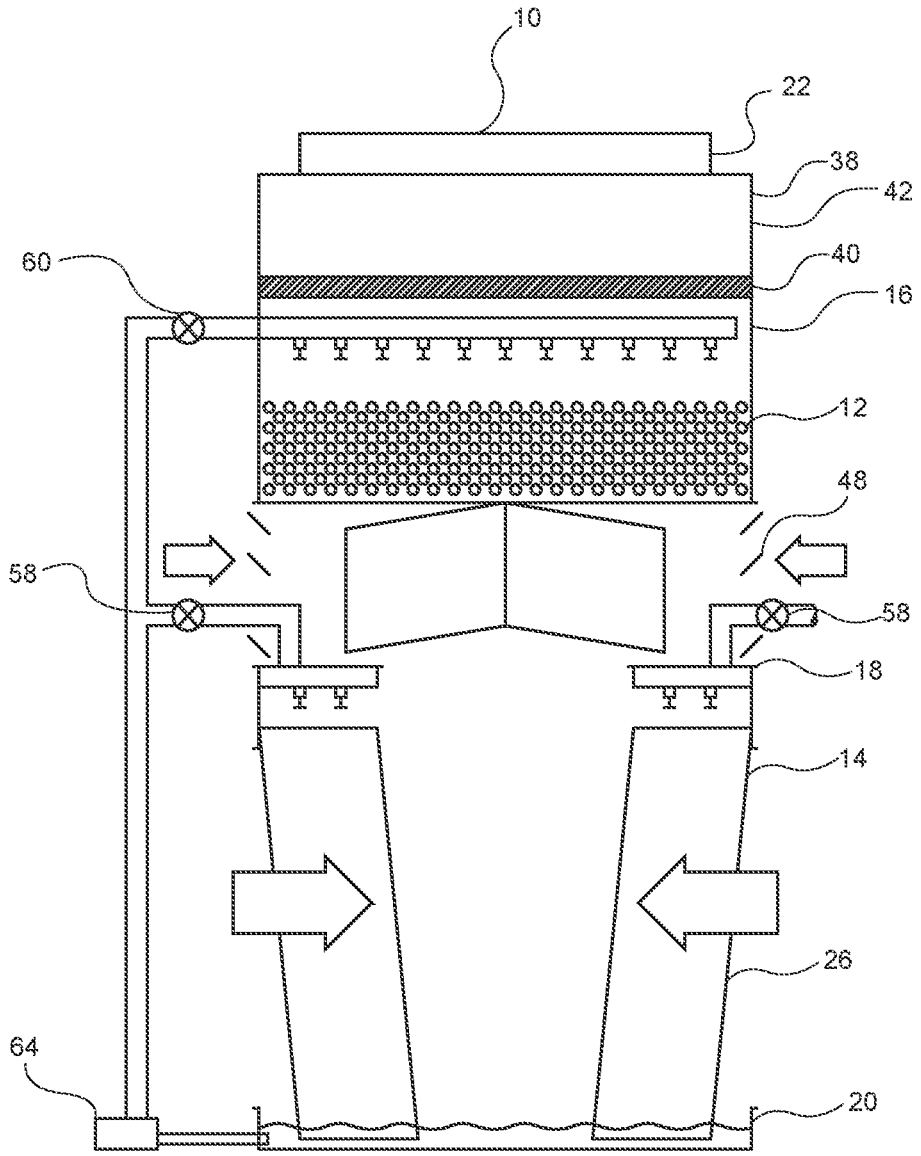
FIG. 2 is a cutaway view through the side of a multiple mode hybrid heat exchanger that is narrower in comparison to the multiple mode hybrid heat exchanger depicted in FIG. 1.
Figure 3:
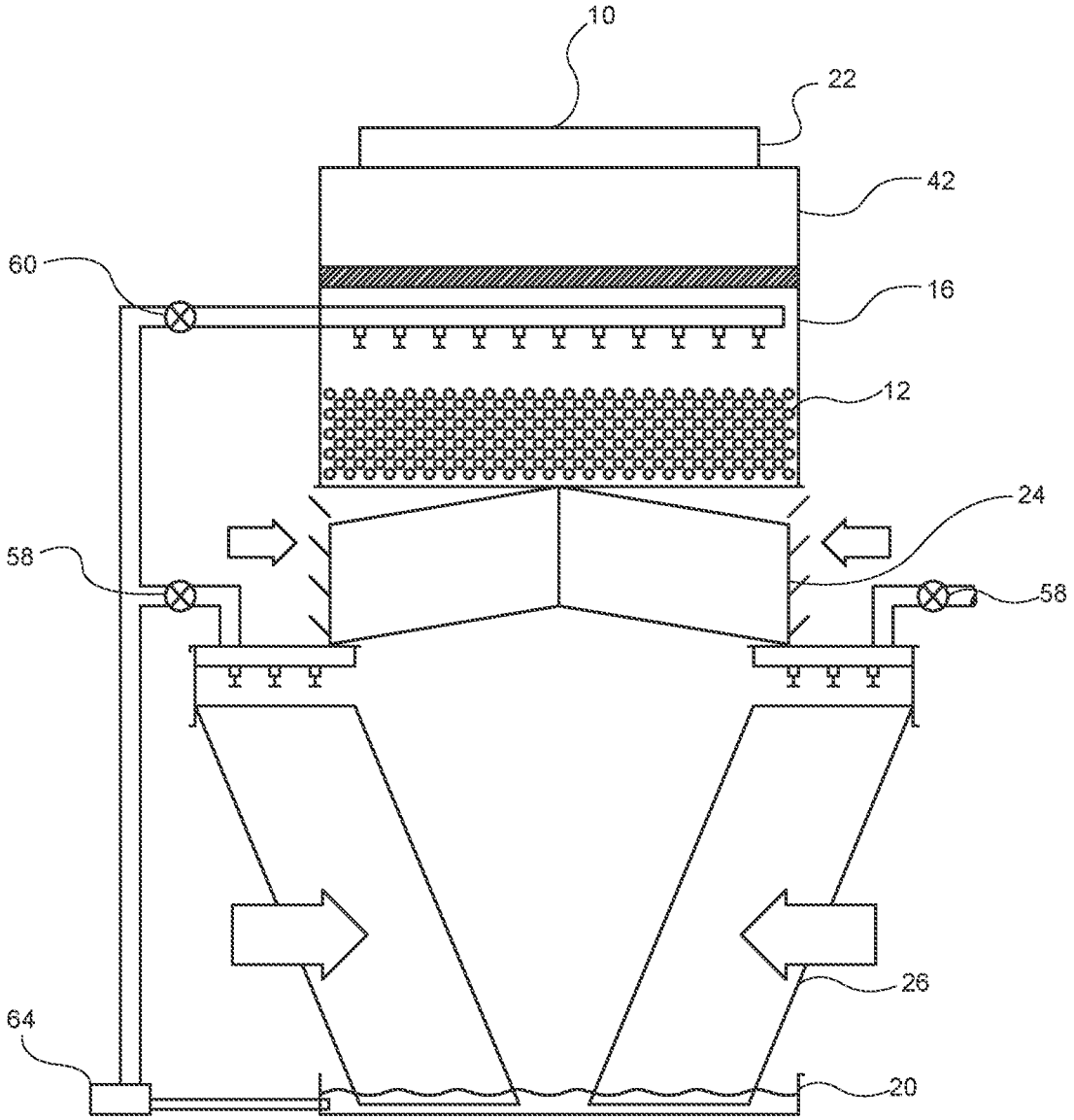
FIG. 3 is a cutaway view through the side of a multiple mode hybrid heat exchanger that has a wider direct HE section in comparison to the multiple mode hybrid heat exchanger depicted in FIG. 2 and includes upper air inlets from the two sides. Inlet louvers 48 can also be used to control the air flow through the upper air inlets.

FIG. 2 is a cutaway view through the side of the multiple mode hybrid heat exchanger 10 that is narrower in comparison to the multiple mode hybrid heat exchanger 10 depicted in FIG. 1. As shown in FIG. 2, the dimensions and/or aspect ratio of the height to the width of the multiple mode hybrid heat exchanger 10 may be modified while staying within the purview of the various embodiments of the invention.

FIG. 3 is a cutaway view through the side of the multiple mode hybrid heat exchanger 10 that includes a more steeply angled fill pack in comparison to the multiple mode hybrid heat exchanger 10 depicted in FIG. 1 and includes upper air inlets. The multiple mode hybrid heat exchanger 10 shown in FIG. 3 is similar to the multiple mode hybrid heat exchanger 10 shown in FIG. 2 with the exception of the fill media being raked at a higher angle in the direct HE section 14.

Figure 4:
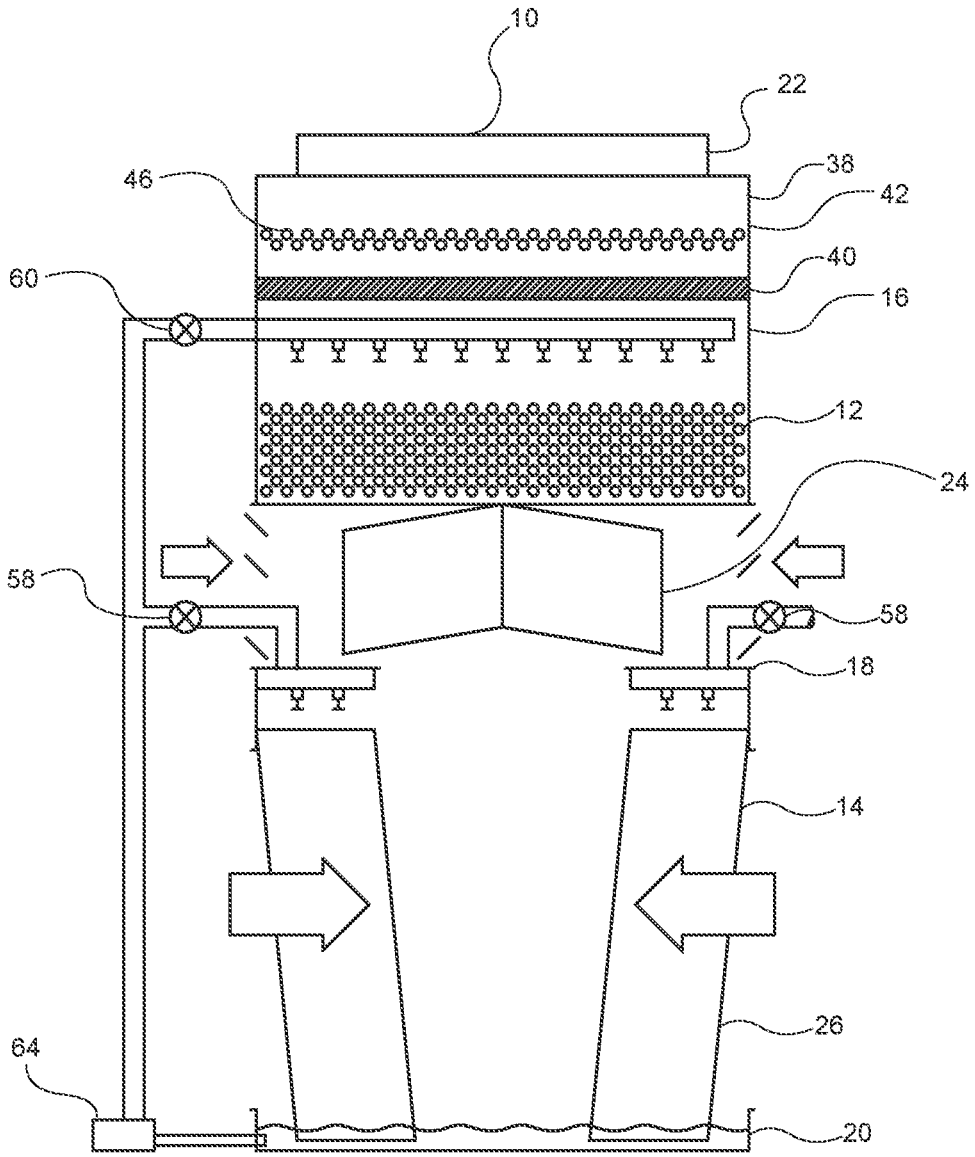
FIG. 4 is a cutaway view through the side of a multiple mode hybrid heat exchanger that includes a secondary finned heat exchanger in comparison to the multiple mode hybrid heat exchanger depicted in FIG. 2.

FIG. 4 is a cutaway view through the side of the multiple mode hybrid heat exchanger 10 that includes a secondary indirect finned heat exchanger 46. The secondary indirect finned heat exchanger 46 shown in FIG. 4 is configured to provide improved dry mode heat transfer.

Figure 5:
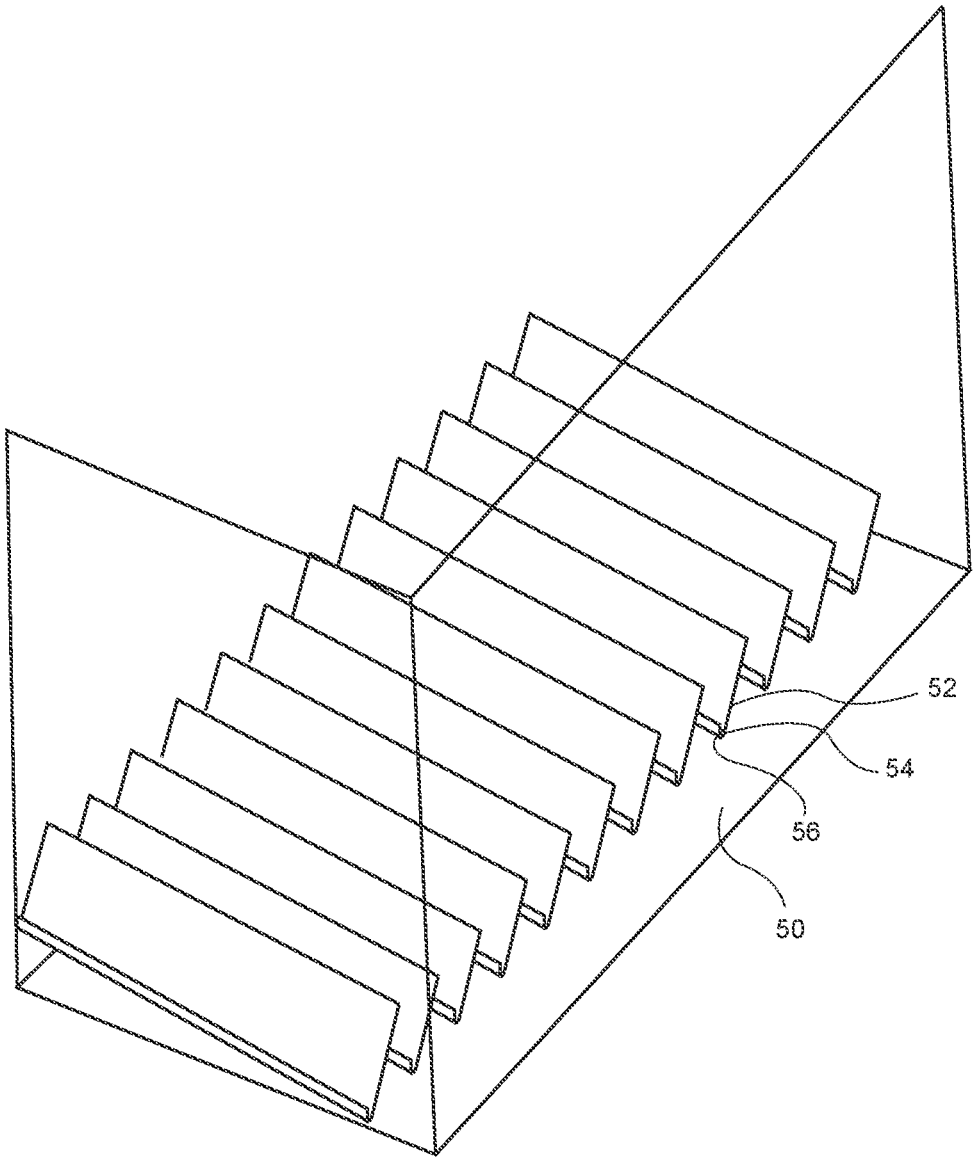
FIG. 5 is an orthogonal projection of a water collection assembly for the multiple mode hybrid heat exchanger of FIG. 1.

FIG. 5 is an orthogonal projection of the water collection assembly 24 for the multiple mode hybrid heat exchanger 10 of FIG. 1. As shown in FIG. 5, the water collection assembly 24 includes a plurality of water collecting vanes 50. Each water collecting vane 50 includes a sloped face 52 configured to redirect a flow of water falling down from above. At the lower edge of each water collecting vane 50 is a channel 54 defined by the intersection of the sloped face 52 with a vertical face 56. The water collection assembly 24 is raised along a central line in comparison to the sides of the water collection assembly 24 so that collected water runs along the channels and into the hot water basin 18. In this manner, the flow of air is allowed to flow up through the water collection assembly 24 while the water is redirected and collected to be distributed onto the direct HE section 14.

Figure 6:
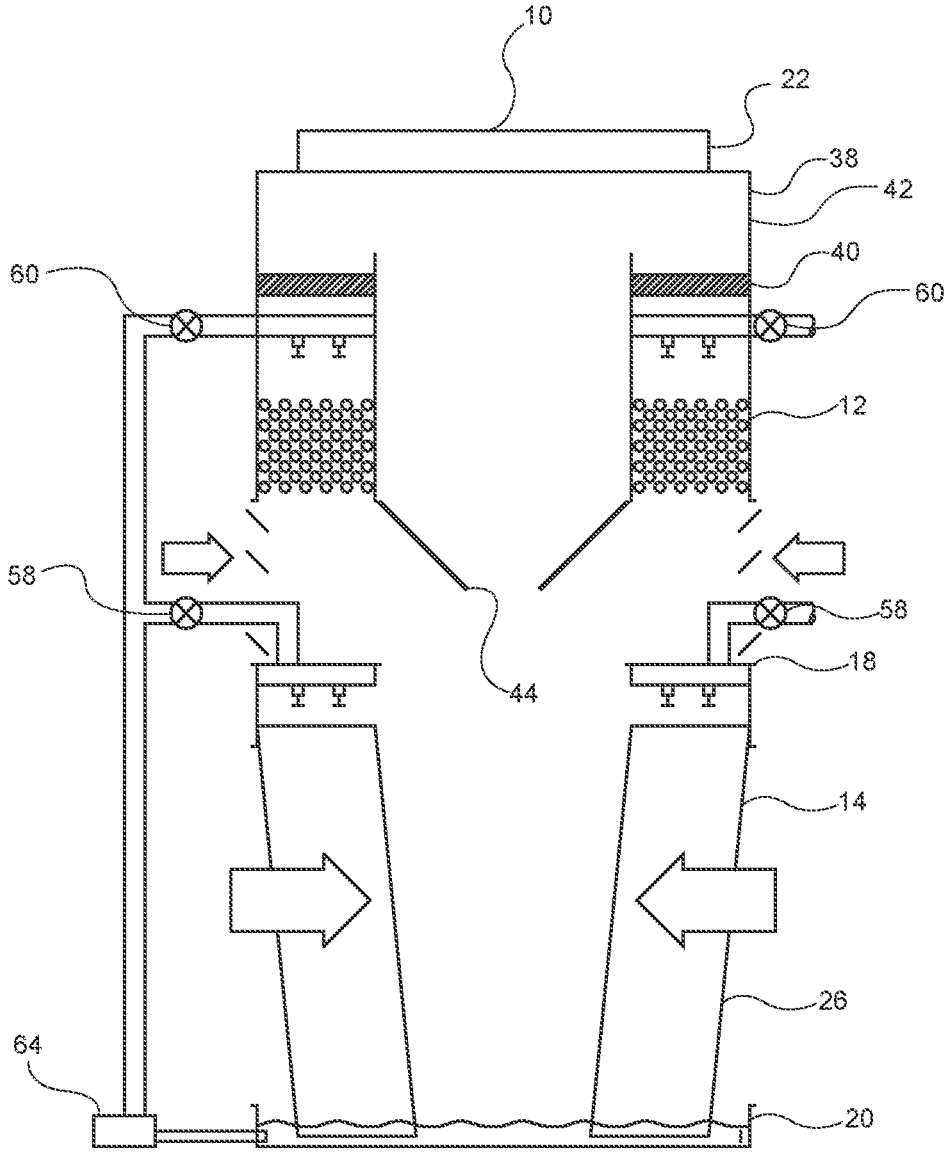
FIG. 6 is a cutaway view through the side of a multiple mode hybrid heat exchanger with internal dampers and inlet louvers.

FIG. 6 is a cutaway view through the side of the multiple mode hybrid heat exchanger 10 that includes internal dampers 44 and a vertical passage extending up through an indirect heat exchange section. As shown in FIG. 6, the internal dampers 44 are configured to rotate or swing to modulate the flow of air through the vertical passage 30. As described in greater detail herein, rotation of the dampers 44 is configured to modulate the airflow in the multiple mode hybrid heat exchanger 10 so that less or more of the airflow passes through the indirect HE section 12. In this manner, the multiple mode hybrid heat exchanger 10 may be selectively controlled and optimized to operate in "dry mode", "adiabatic mode", or "evaporative mode". In addition, the multiple mode hybrid heat exchanger 10 includes hot water basin valves 58, spray system valves 60 and a recirculating pump 64. The hot water basin valves 58 are configured to control a flow of water to the hot water basin 18. The spray system valves 60 are configured to control a flow of water supplied to the indirect heat exchanger 12. The recirculating pump 64 is configured to pump water up from the cold water basin 20 to the hot water basin valves 58 and spray system valves 60.

In some operations, water from the spray system valves 60, falls through the indirect heat exchange 12 and then collects in the hot water basin 18. In other operations, the hot water basin valves 58 may supply water to the hot water basin 18, for example, if water is not supplied to the indirect heat exchanger 12. It is an advantage of the multiple mode hybrid heat exchanger 10 shown in FIG. 6 that the multiple mode hybrid heat exchanger 10 is operable to selectively operate in each of the operational modes shown in FIGS. 7-12 and thus, may be optimized to operate in a variety of environmental conditions. Table I below summarizes the operating modes of the multiple mode hybrid heat exchanger 10 according to FIGS. 7-12:

TABLE I

| FIG # | Mode | Indirect HE Spray (Primary Coil) | Direct HE Spray (FILL) | Upper Inlet Louver Position | Interior Damper Door Position |
|---|---|---|---|---|---|
| 7 | Evaporative | Valves OPEN | Valves CLOSED/ Gravity Flow | OPEN | Closed Vertical |
| 8 | Adiabatic | Valves CLOSED | Valves OPEN | CLOSED | Closed Horizontal |
| 9 | Dry | Valves CLOSED | Valves CLOSED | OPEN | Closed Horizontal |

TABLE I-continued

| FIG # | Mode | Indirect HE Spray (Primary Coil) | Direct HE Spray (FILL) | Upper Inlet Louver Position | Interior Damper Door Position |
|---|---|---|---|---|---|
| 10 | Evaporative/Dry | Side A-Open Side B-closed | Side A-Gravity Side B-Closed | OPEN | Both Sides-Closed Horizontal Side A-Closed Vertical" |
| 11 | Evaporative/ Adiabatic | Side A Closed Side B Open | Side A-Open Side B-Gravity | Side A-Closed Side B-Open | Both Sides-Closed Horizontal Side B-Closed Vertical" |
| 12 | Adiabatic/Dry | Valves Closed | Valves Open | Side A-Closed Side B-Open | Both Sides-Closed Horizontal Side B-Closed Vertical" |

In Table I, reference is made to opening and closing the indirect heat exchange spray valves 60, the direct heat exchange spray valves 58. the upper inlet louvers 48, and the internal dampers 44. For the purpose of this disclosure, it is to be understood that the term, "open" is defined as facilitating the flow of fluid (air, water, or the like) therethrough and that the term, "closed" is defined as restricting the flow of fluid. For example, valves, louvers, and dampers may leak fluid when 'closed'. Additionally, even partially open, valves, louvers, and dampers may allow suitable flow to provide sufficient cooling.

Figure 7:
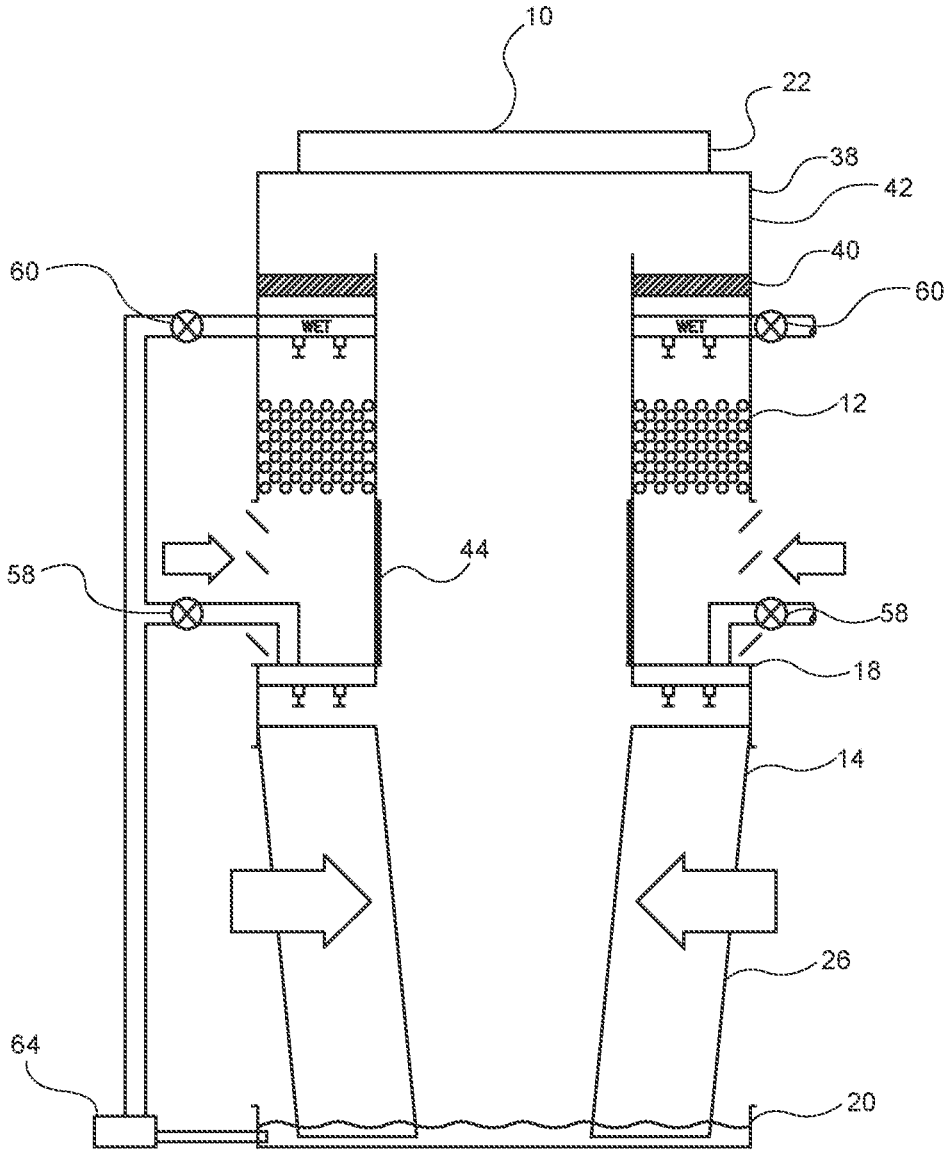
FIG. 7 is a cutaway view through the side of the multiple mode hybrid heat exchanger of FIG. 6 in an evaporative mode with vertically closed internal dampers and open inlet louvers, with the hydraulic valves activated on the indirect HE sections.

FIG. 7 is a cutaway view through the side of the multiple mode hybrid heat exchanger 10 of FIG. 6 in an evaporative mode with vertically closed internal dampers and open inlet louvers. In this orientation, the internal dampers 44 form a vertical passage extending up through an indirect heat exchange section 12. As shown in FIG. 7, the internal dampers 44 are configured to rotate or swing to modulate the flow of air through the vertical passage 30. As described in greater detail herein, rotation of the dampers 44 is configured to modulate the airflow in the multiple mode hybrid heat exchanger 10 so that less or more of the airflow passes through the indirect HE section 12. In this configuration, the spray system valves 60 are activated, and spray is applied to the indirect HE section, and reapplied to the direct HE system 14 though fluid initially collected in the Hot Water Basin 18. In this manner, the multiple mode hybrid heat exchanger 10 may be selectively controlled and optimized to operate in evaporative or "wet mode".

Figure 8:
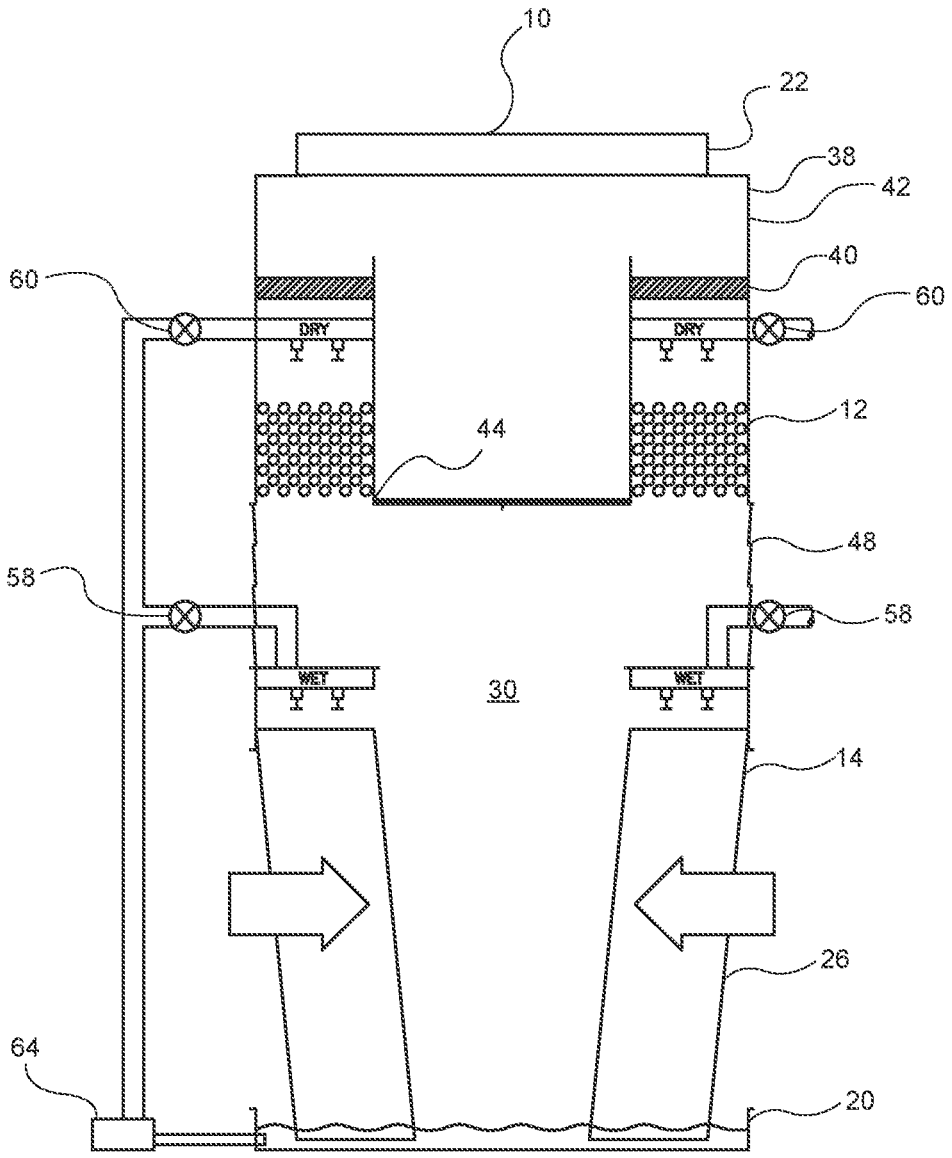
FIG. 8 is a cutaway view through the side of the multiple mode hybrid heat exchanger of FIG. 6 in an adiabatic mode with horizontally closed internal dampers and closed inlet louvers, with the hydraulic valves activated only on the direct HE sections.

FIG. 8 is a cutaway view through the side of the multiple mode hybrid heat exchanger 10 of FIG. 6 in an adiabatic mode with horizontally closed internal dampers 44 and closed inlet louvers 48. As shown in FIG. 8, with the dampers 44 rotated to close the vertical passage 30 up from the direct HE section 14, substantially all of the airflow may be drawn through the indirect HE section 12. The water from the spray system 16 bypasses the indirect HE section 12 and is directed only to the direct HE section 14 via activation of the Hot Water Basin valves 58. In this configuration, the multiple mode hybrid heat exchanger 10 is operating in adiabatic mode.

Figure 9:
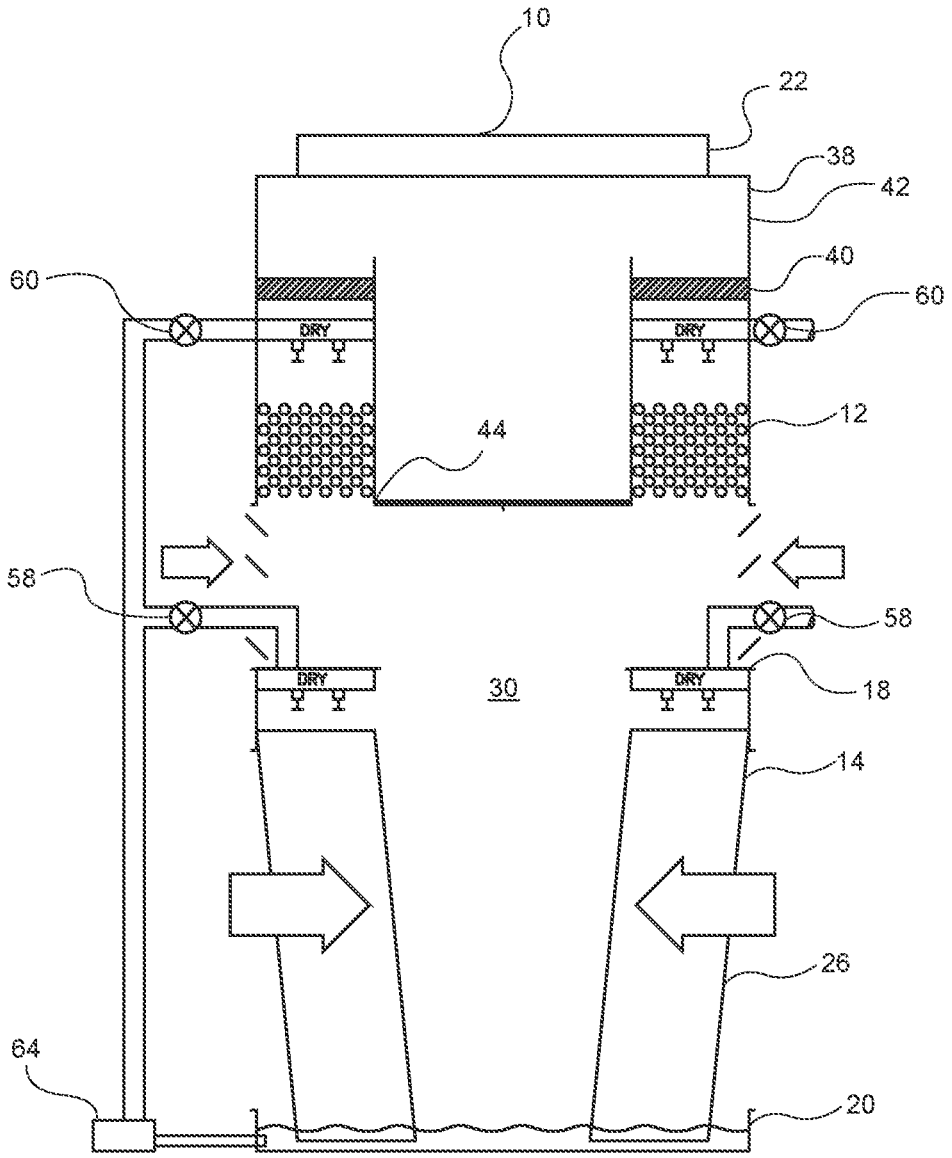
FIG. 9 is a cutaway view through the side of the multiple mode hybrid heat exchanger of FIG. 6 in a dry mode with horizontally closed internal dampers and open inlet louvers, with the hydraulic valves deactivated on the indirect HE and the direct HE sections.

FIG. 9 is a cutaway view through the side of the multiple mode hybrid heat exchanger of FIG. 6 in a dry mode with horizontally closed internal dampers 44 and open inlet louvers 48. As shown in FIG. 9, with the dampers 44 rotated to close the vertical passage 30 up from the direct HE section 14, substantially all of the airflow may be drawn through the indirect HE section 12. The spray system 16 is deactivated so that no water passes down through the indirect HE section 12 or on the direct HE section 14. In this manner, the multiple mode hybrid heat exchanger 10 is operating in dry mode. Of note, although in 'Dry Mode', the process water flowing through the heat exchange conduits of the multiple mode hybrid heat exchanger 10 may always be circulating.

Figure 10:
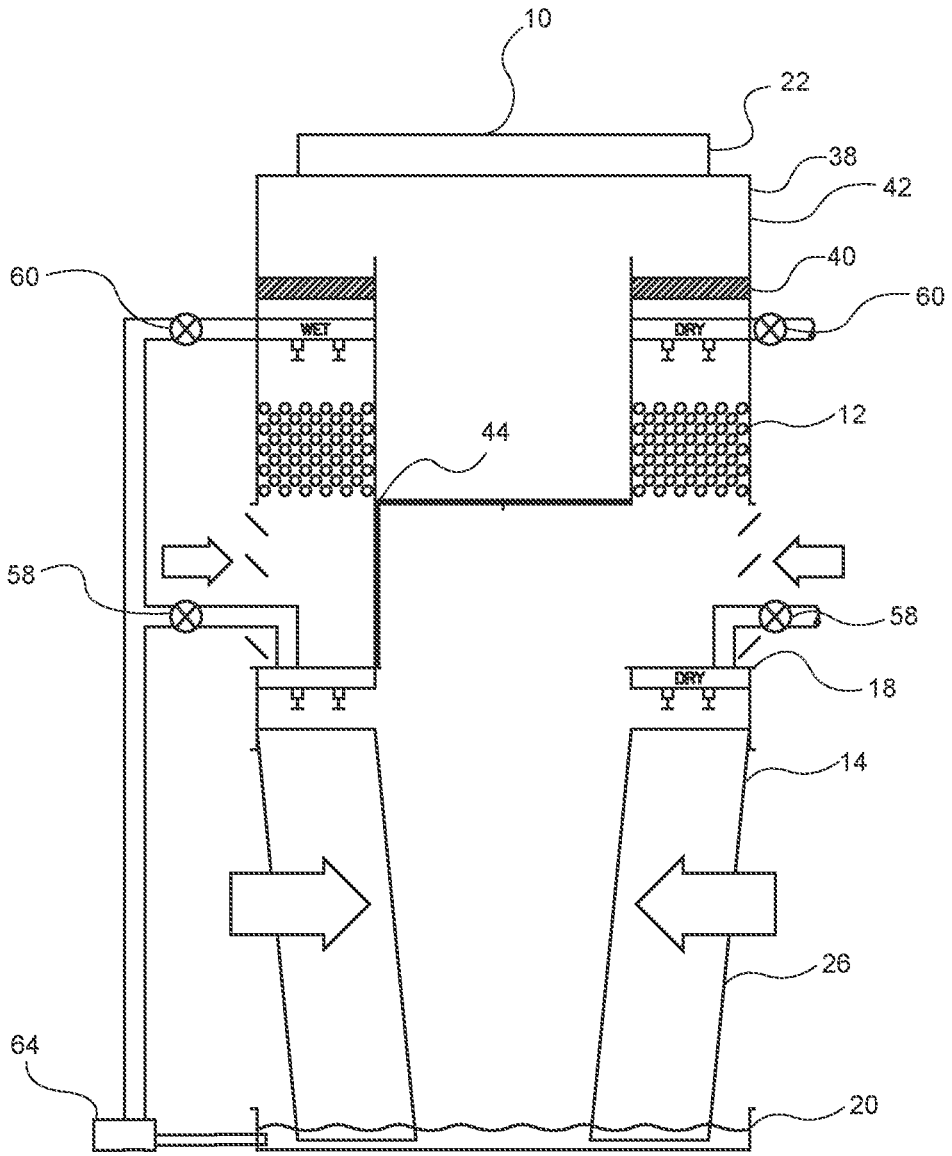
FIG. 10 is a cutaway view through the side of the multiple mode hybrid heat exchanger of FIG. 6 in an evaporative—dry mode with horizontally closed internal dampers and open inlet louvers, with the hydraulic valves activated on the indirect HE sections of one side of the system only, and the other side's valves deactivated.

FIG. 10 is a cutaway view through the side of the multiple mode hybrid heat exchanger 10 of FIG. 6 in an evaporative—dry mode with horizontally closed internal dampers 44 and open inlet louvers 48. As shown in FIG. 10, with the dampers 44 rotated to close the vertical passage 30 up from the direct HE section 14, substantially all of the airflow may be drawn through the indirect HE section 12. This allows the hybrid heat exchanger to operate in two modes simultaneously. On one side of the multiple mode hybrid heat exchanger, water from the spray system 16 passes down through one side of the indirect HE section 12 and on to the direct HE section 14. In addition, the other side of the indirect HE section 12 may have the spray deactivated and be closed off with an option damper door 44. In this configuration the multiple mode hybrid heat exchanger 10 is operating in evaporative—dry mode.

Figure 11:
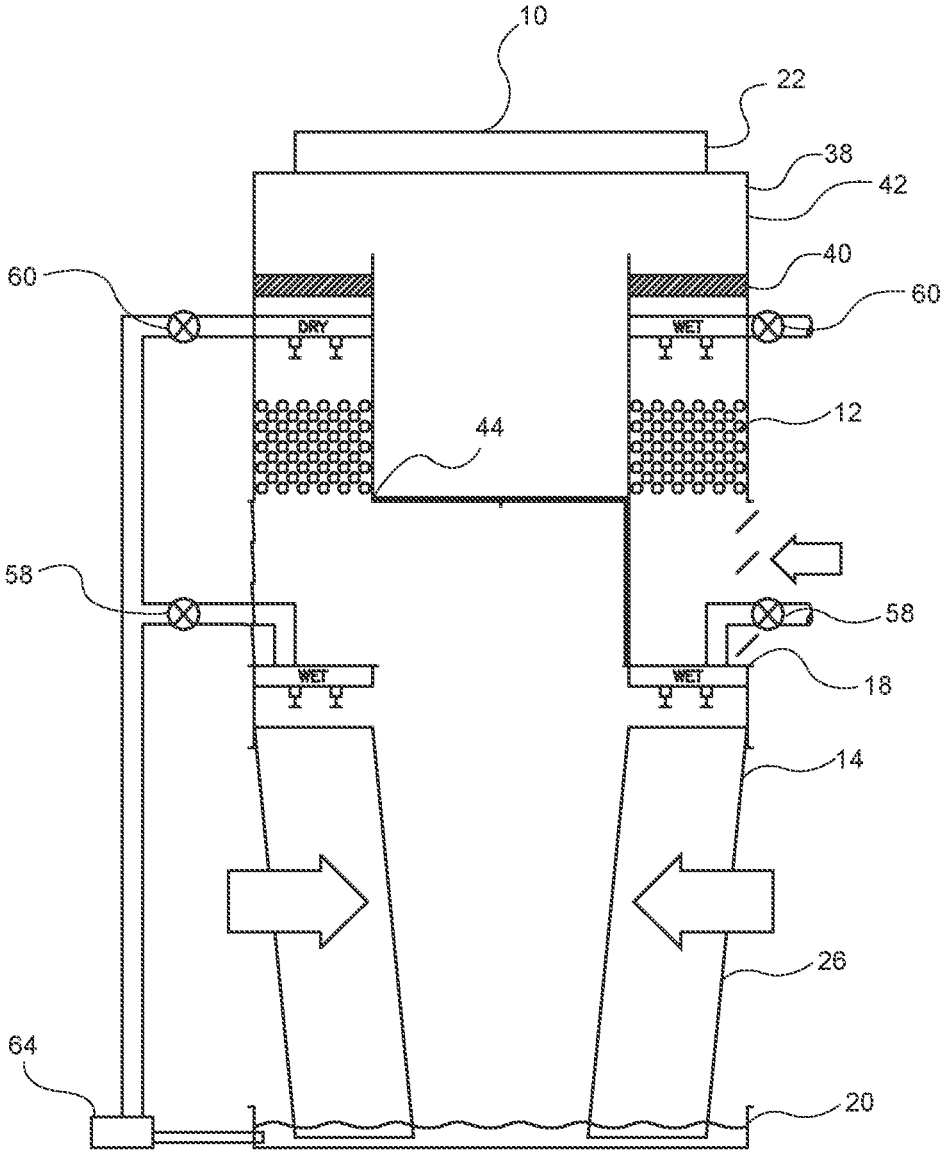
FIG. 11 is a cutaway view through the side of the multiple mode hybrid heat exchanger of FIG. 6 in an evaporative—adiabatic mode with horizontally closed internal dampers and partially closed inlet louvers, with the hydraulic valves activated on the indirect HE section on side one of the system, and valves active only on the other side's direct HE section.

FIG. 11 is a cutaway view through the side of the multiple mode hybrid heat exchanger 10 of FIG. 6 in an evaporative—adiabatic mode with horizontally closed internal dampers 44 and partially closed inlet louvers 48. As shown in FIG. 11, on one side of the hybrid heat exchanger with the dampers 44 rotated to close the vertical passage 30 up from the direct HE section 14, substantially all of the airflow may be drawn through the indirect HE section 12. The water from one side of the spray system 16 passes down through the indirect HE section 12 disposed below, collects in the hot water basin 18, and on to the direct HE section 14. For example, each of the valves 58 and each of the valves 60 of the spray system 16 may be independently controlled. As shown in FIG. 11, the valve 60 on the left is closed while the valve 60 on the right is in the open position. The valve 58 on both the left and right are in the open position. In addition, the other side of the indirect HE section 12 may be closed off with an option damper door 44 and the inlet louvers 48 on the opposite side may be closed to increase draw through the direct HE 14. In this configuration of the dampers 44, the multiple mode hybrid heat exchanger 10 is operating in evaporative—adiabatic mode.

Figure 12:
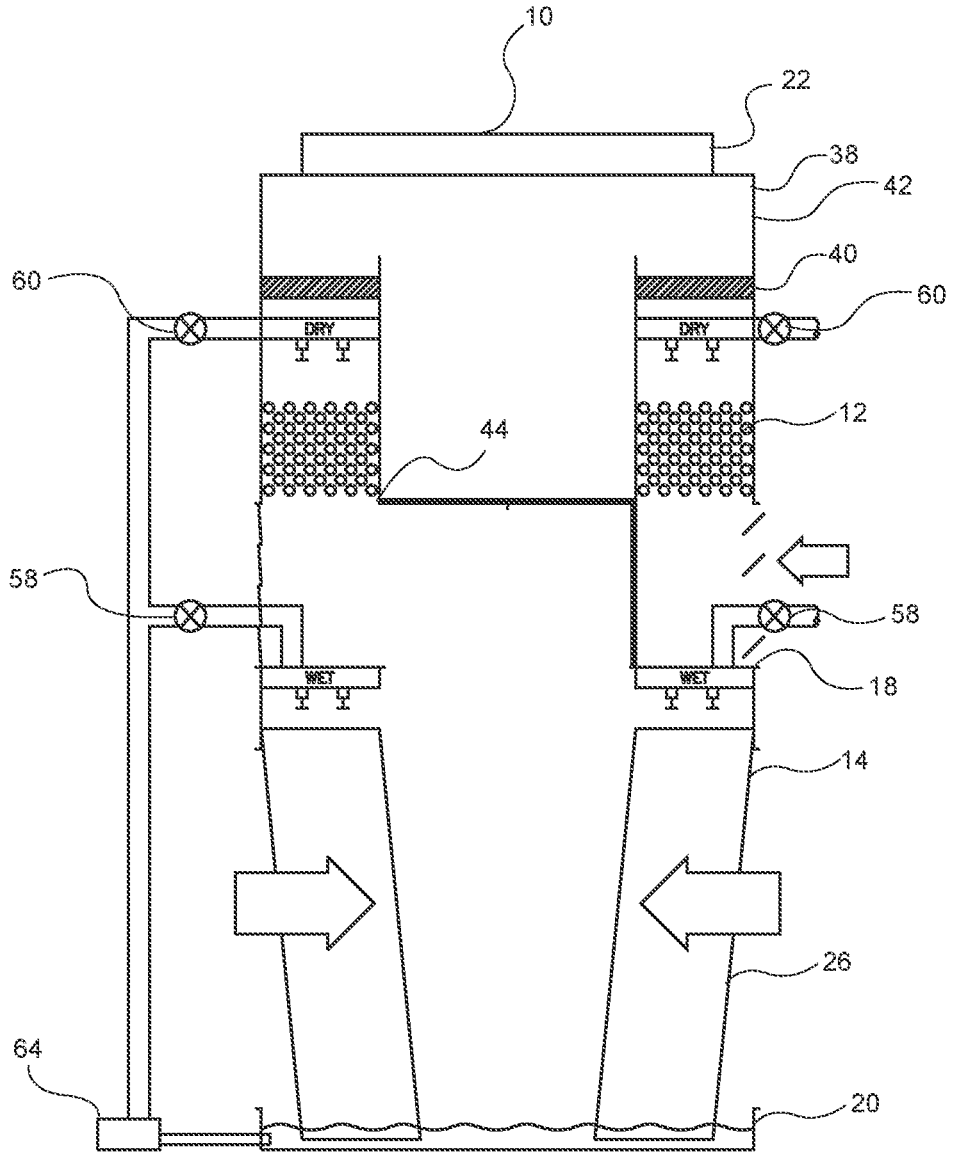
FIG. 12 is a cutaway view through the side of the multiple mode hybrid heat exchanger of FIG. 6 in an adiabatic—dry mode with horizontally closed internal dampers and partially closed inlet louvers, with only the direct HE hydraulic valves activated.

FIG. 12 is a cutaway view through the side of the multiple mode hybrid heat exchanger 10 of FIG. 6 in an adiabatic—dry mode with horizontally closed internal dampers 44 and partially closed inlet louvers 48. As shown in FIG. 12, with the dampers 44 rotated to close the vertical passage 30 up from the direct HE section 14, substantially all of the airflow may be drawn through the indirect HE section 12. The spray system valves 60 are closed to stop the flow of water from the spray system 16 and water is supplied to the hot water basin 18 via opening the hot water basin valve 58. In addition, the other side of the indirect HE section 12 may be closed off with an option damper door 44 and the inlet louvers 48 on the opposite side may be closed to increase draw through the wetted direct HE 14. In this configuration the multiple mode hybrid heat exchanger 10 is operating in adiabatic—dry mode.

Figure 13:
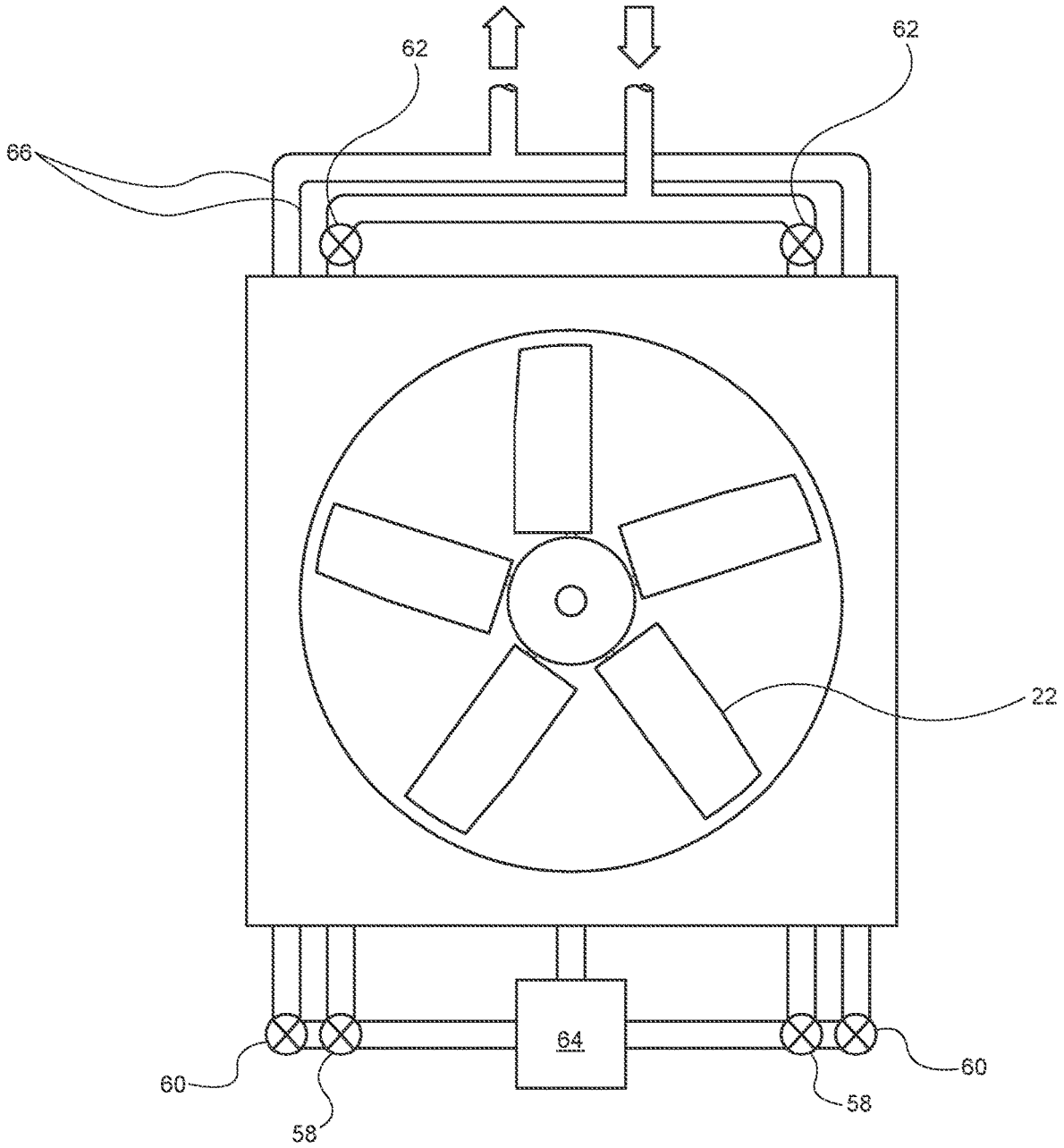
FIG. 13 is a plan view showing inlet and outlet piping, valves, and pump of the multiple mode hybrid heat exchanger of FIG. 6.

FIG. 13 is a plan view showing inlet and outlet piping 66, hot water basin valves 58, spray system valves 60, heat exchanger valves 62, and recirculating pump 64 of the multiple mode hybrid heat exchanger 10 of FIG. 6. As shown in FIG. 13, each of the valves 58-62 may be operated independently and systems to each side of the multiple mode hybrid heat exchanger 10 may be operated independently from the other side.

Figure 14:
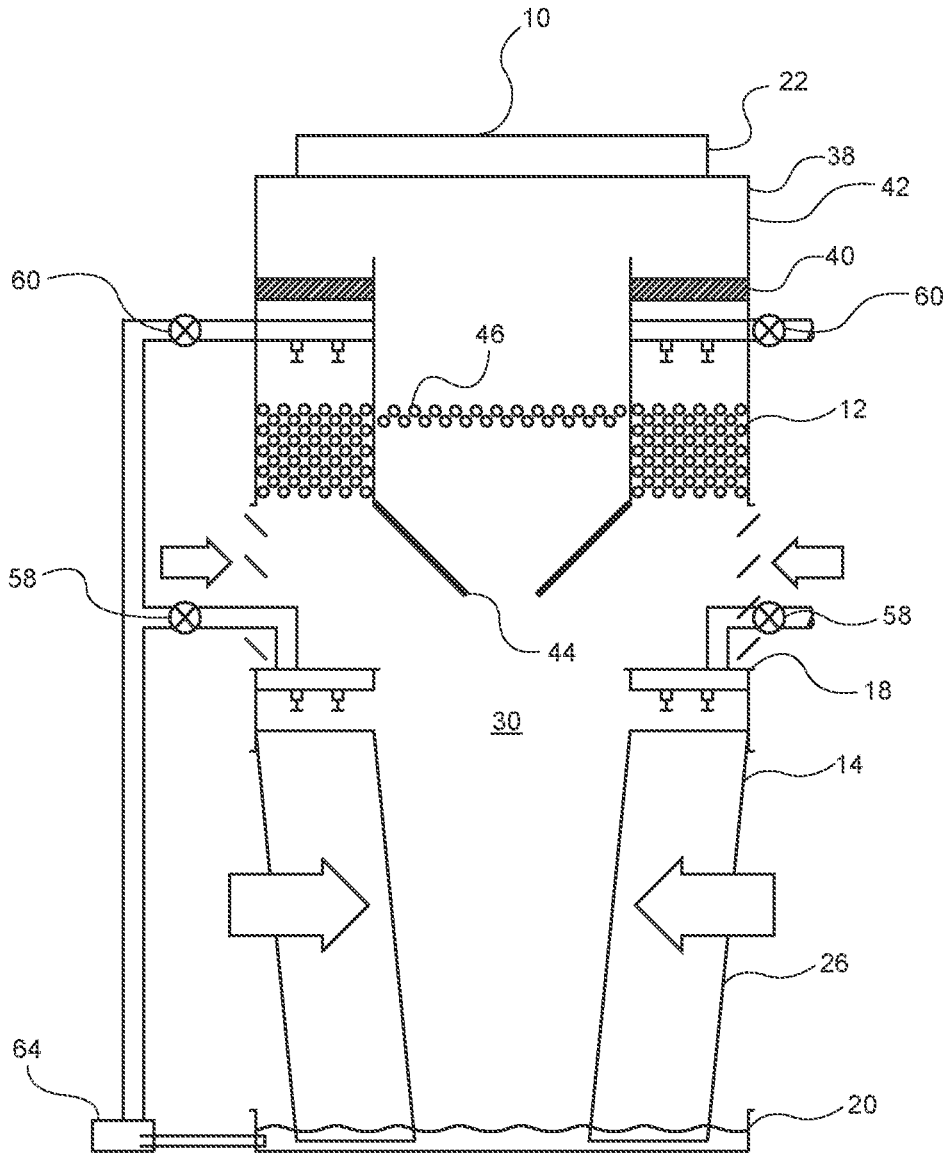
FIG. 14 is a cutaway view through the side of a multiple mode hybrid heat exchanger with internal dampers, inlet louvers, and a secondary finned heat exchanger.

FIG. 14 is a cutaway view through the side of a multiple mode hybrid heat exchanger 10 with internal dampers 44, inlet louvers 48, and a secondary finned heat exchanger 46. The dry finned coils 46 is disposed in the vertical passage 30 and may augment cooling from the indirect HE section 12. In this regard, the dry finned coils 46 may be connected in series or parallel with the coils of the indirect HE section 12. It is an advantage of the multiple mode hybrid heat exchanger 10 shown in FIG. 14 that the multiple mode hybrid heat exchanger 10 is operable to selectively operate in each of the operational modes shown in FIGS. 15-20 and thus, may be optimized to operate in a variety of environmental conditions. Table II below summarizes the operating modes of the multiple mode hybrid heat exchanger 10 according to FIGS. 15-20:

TABLE II

| FIG # | Mode | Indirect HE Spray (Primary Coil) | Direct HE Spray (FILL) | Upper Inlet Louver Position | Interior Damper Door Position |
|---|---|---|---|---|---|
| 15 | Evaporative | Valves OPEN | Valves CLOSED/ Gravity Flow | OPEN | Closed Vertical |
| 16 | Adiabatic | Valves CLOSED | Valves OPEN | CLOSED | Partial Open |
| 17 | Dry | Valves CLOSED | Valves CLOSED | OPEN | Closed Vertical |
| 18 | Evaporative/Dry | Side A - Open<br>Side B - closed | Side A - Gravity<br>Side B - Either | OPEN | Closed Vertical |
| 19 | Evaporative/ Adiabatic | Side A Closed<br>Side B Open | Side A-Open<br>Side B-Gravity | Side A-Closed<br>Side B-Open | Side A-Partial Open<br>Side B - Closed Vertical" |
| 20 | Adiabatic/Dry | Valves Closed | Side a- Open<br>Side B-Either | Side A-Closed<br>Side B-Open | Side A-Partial Open<br>Side B - Closed Vertical" |

In Table II, reference is made to opening and closing the indirect heat exchange spray valves 60, the direct heat exchange spray valves 58. the upper inlet louvers 48, and the internal dampers 44. For the purpose of this disclosure, it is to be understood that the term, "open" is defined as facilitating the flow of fluid (air, water, or the like) therethrough and that the term, "closed" is defined as restricting the flow of fluid. For example, valves, louvers, and dampers may leak fluid when 'closed'. Additionally, even partially open, valves, louvers, and dampers may allow suitable flow to provide sufficient cooling.

Figure 15:
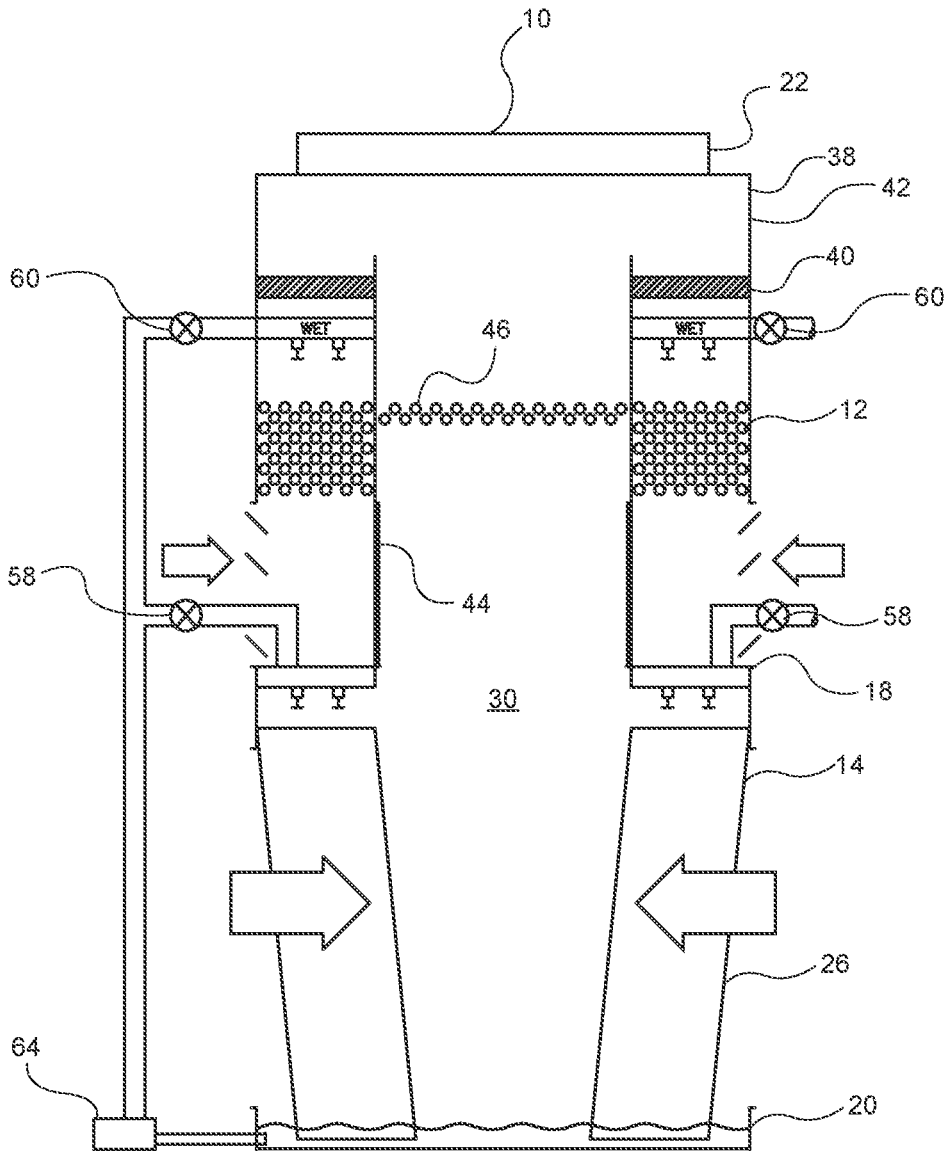
FIG. 15 is a cutaway view through the side of the multiple mode hybrid heat exchanger according to FIG. 14 in evaporative mode with vertically closed internal dampers and open inlet louvers, with the hydraulic valves activated on the indirect HE sections.

FIG. 15 is a cutaway view through the side of the multiple mode hybrid heat exchanger 10 according to FIG. 14 in evaporative mode with vertically closed internal dampers 44 and open inlet louvers 48. In this orientation, the internal dampers 44 form a vertical passage 30 extending up through an indirect heat exchange section 12. As shown in FIG. 15, the internal dampers 44 are configured to rotate or swing to modulate the flow of air through the vertical passage 30. As described in greater detail herein, rotation of the dampers 44 is configured to modulate the airflow in the multiple mode hybrid heat exchanger 10 so that less or more of the airflow passes through the indirect HE section 12. As shown in FIG. 15, with the dampers 44 rotated to open the vertical passage 30 up from the direct HE section 14, a greater amount of airflow may be drawn in through the direct HE section 14 and this flow of air is then drawn through the secondary finned heat exchanger 46. The water from the spray system 16 passes down through the indirect HE section 12 and on to the direct HE section 14. In this manner, the multiple mode hybrid heat exchanger 10 may be selectively controlled and optimized to operate in evaporative or "wet mode".

Figure 16:
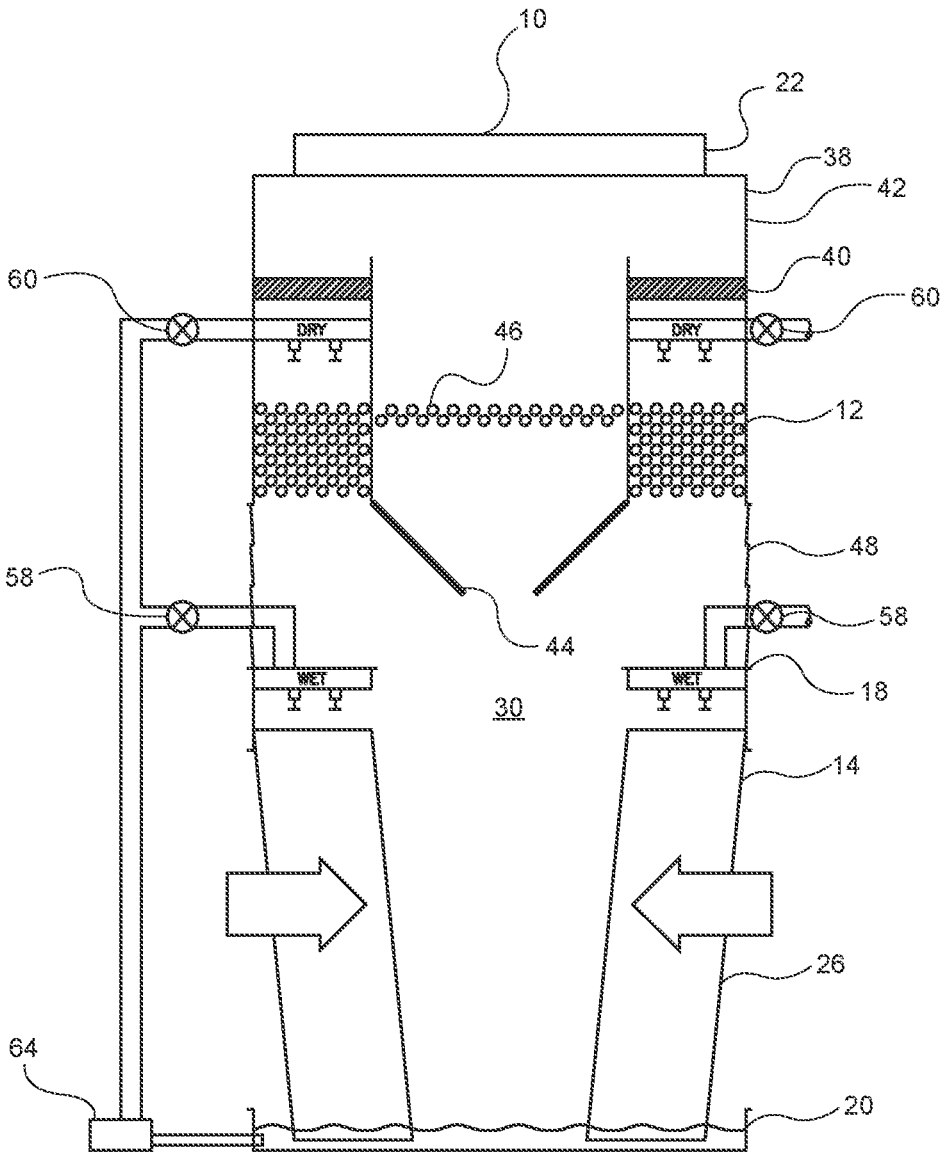
FIG. 16 is a cutaway view through the side of the multiple mode hybrid heat exchanger according to FIG. 14 in adiabatic mode with partially closed internal dampers and closed inlet louvers, with the hydraulic valves activated only on the direct HE sections.

FIG. 16 is a cutaway view through the side of the multiple mode hybrid heat exchanger 10 according to FIG. 14 in adiabatic mode with partially closed internal dampers 44 and closed inlet louvers 48. As shown in FIG. 16, with the dampers 44 rotated to partially close the vertical passage 30 up from the direct HE section 14, a portion of the airflow may be drawn through the indirect HE section 12 and this portion may be varied in response to the rotation of the dampers 44. The spray system valve 60 are closed to stop the flow of water through the indirect HE section 12. The hot water basin valves 58 are opened to provide water to the direct HE section 14. In this configuration of the dampers 44, multiple mode hybrid heat exchanger 10 is operating in adiabatic mode with the increased heat exchange via the finned HE 46.

Figure 17:
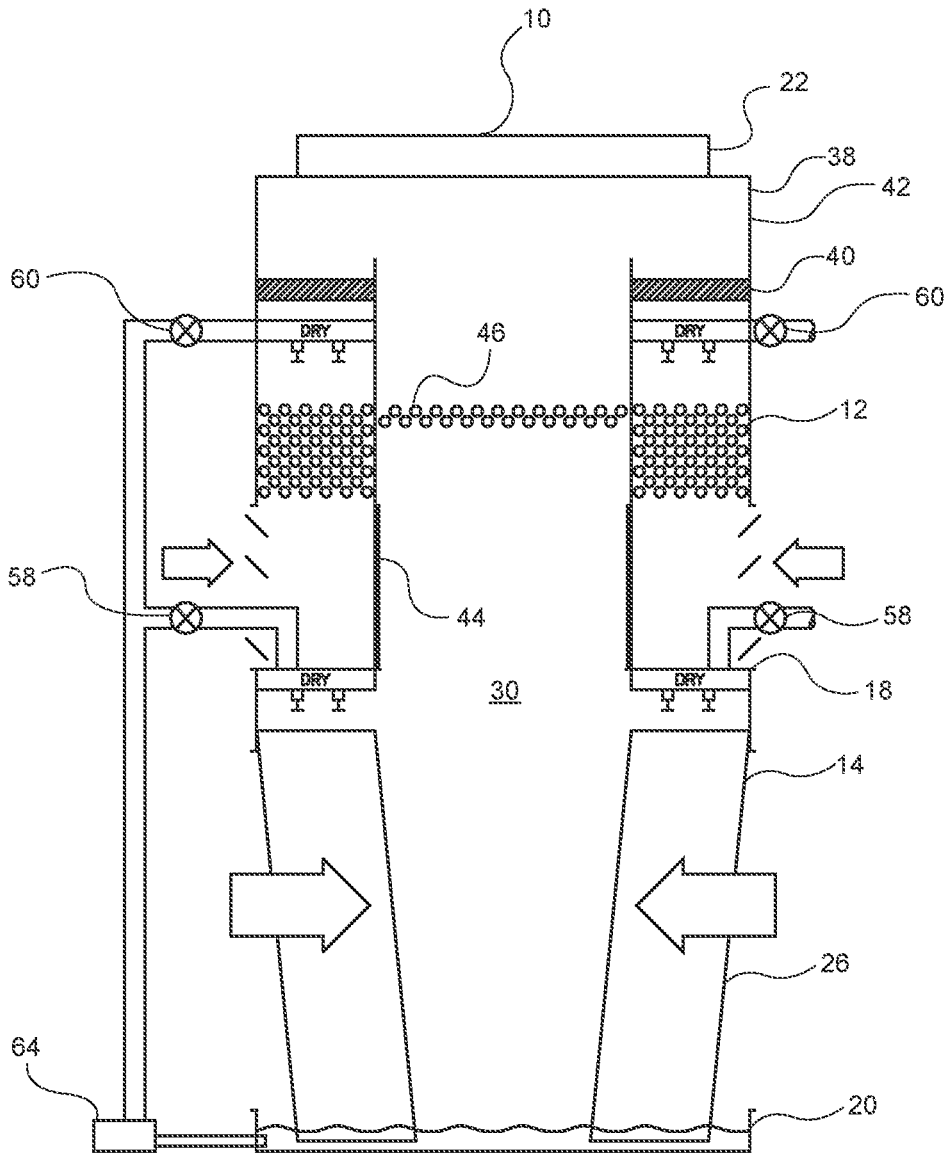
FIG. 17 is a cutaway view through the side of the multiple mode hybrid heat exchanger according to FIG. 14 in dry mode with vertically closed internal dampers and open inlet louvers, with the hydraulic valves deactivated on the indirect HE and the direct HE sections.

FIG. 17 is a cutaway view through the side of the multiple mode hybrid heat exchanger 10 according to FIG. 14 in dry mode with vertically closed internal dampers 44 and open inlet louvers 48. As shown in FIG. 17, with the dampers 44 rotated to open the vertical passage 30 up from the direct HE section 14, the airflow may redirected away from and between the indirect HE section 12. This redirected airflow is directed up through the secondary indirect finned HE 46. The spray system 16 is deactivated so that no water passes down through the indirect HE section 12 and the direct HE section 14 is also dry. The multiple mode hybrid heat exchanger 10 is operating in dry mode.

Figure 18:
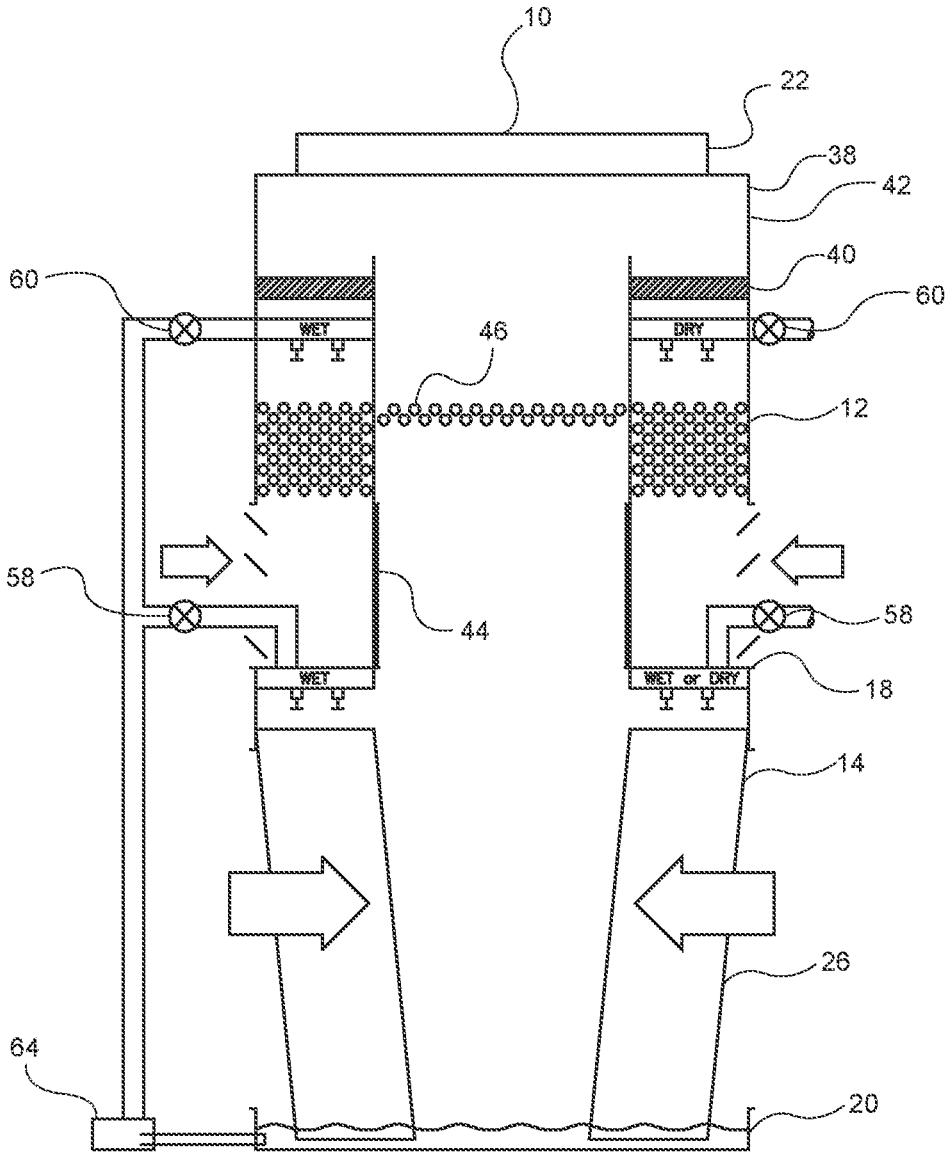
FIG. 18 is a cutaway view through the side of the multiple mode hybrid heat exchanger according to FIG. 14 in evaporative—dry mode with vertically closed internal dampers and open inlet louvers, with the hydraulic valves activated on the indirect HE sections of one side of the system only, and the other side's valves deactivated.

FIG. 18 is a cutaway view through the side of the multiple mode hybrid heat exchanger 10 according to FIG. 14 in evaporative—dry mode with vertically closed internal dampers 44 and open inlet louvers 48. As shown in FIG. 18, with the dampers 44 rotated to open the vertical passage 30 up from the direct HE section 14, substantially all of the airflow may be drawn up through the secondary indirect finned HE section 46. The inlet louvers 48 are open to allow a flow of air into the multiple mode hybrid heat exchanger 10 below the indirect HE 12 and this airflow is then drawn through the indirect HE section 12. The water from the spray system 16 passes down through one side of the indirect HE section 12 and on to the direct HE section 14. Optionally, the hot water basin valve 58 may supply water to the hot water basin 18 on the second side. The multiple mode hybrid heat exchanger 10 is operating in evaporative—dry mode.

Figure 19:
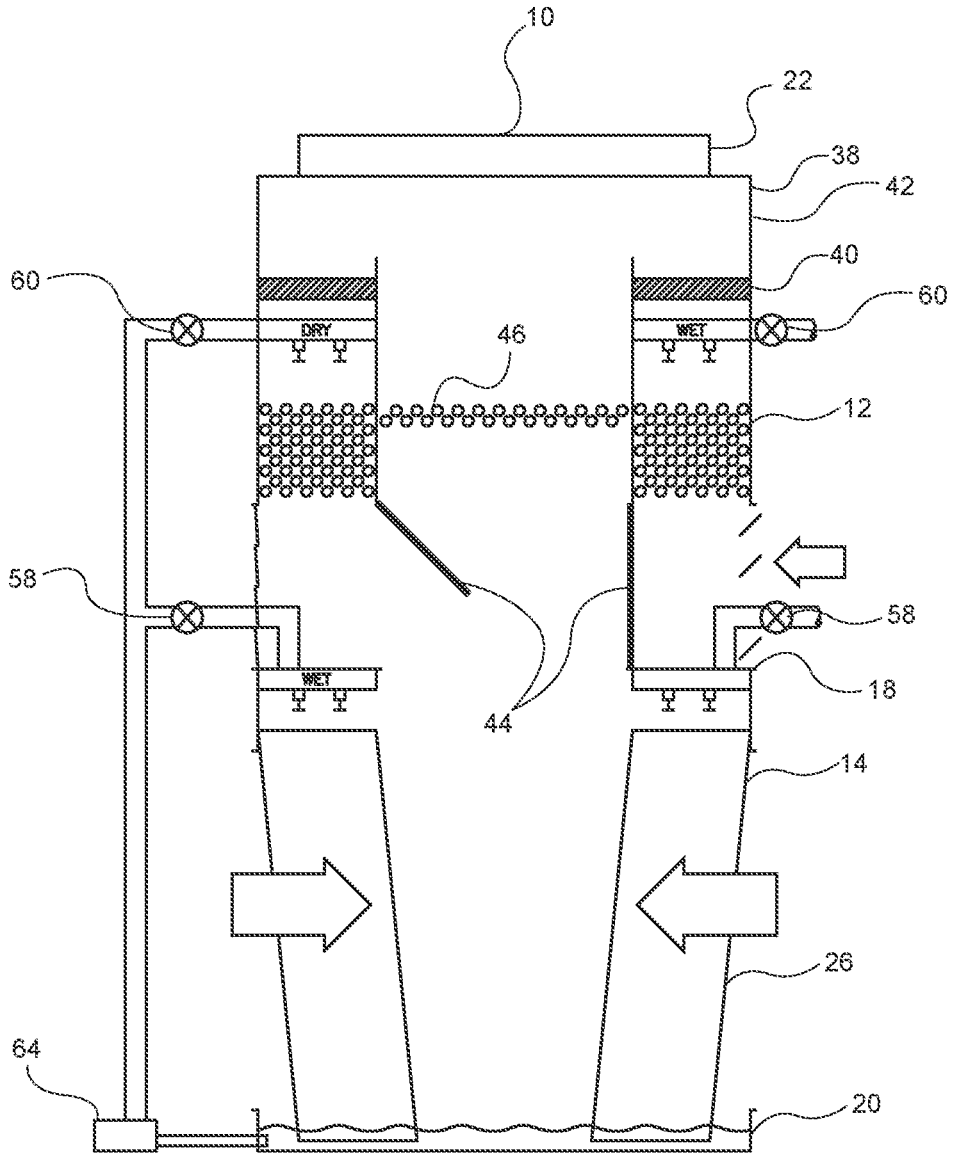
FIG. 19 is a cutaway view through the side of the multiple mode hybrid heat exchanger according to FIG. 14 in evaporative—adiabatic mode with partially closed internal dampers and partially open inlet louvers, with the hydraulic valves activated on the indirect HE section on side one of the system, and valves active only on the other side's direct HE section.

FIG. 19 is a cutaway view through the side of the multiple mode hybrid heat exchanger 10 according to FIG. 14 in evaporative—adiabatic mode with partially closed internal dampers 44 and partially open inlet louvers 48. As shown in FIG. 19, with the dampers 44 rotated to partially close the vertical passage 30 up from the direct HE section 14 on a first side to allow some of the air passing through the direct heat exchanger 14 to be drawn through one side of the indirect HE section 12. On a second side, the water from the spray system 16 passes down through one side the indirect HE section 12 and on to the direct HE section 14 while the inlet louver 48 are open to allow air through the wetted indirect HE 12. In addition, on the first side of the indirect HE section 12, the inlet louvers 48 may be closed to increase draw through the direct HE 14. In this configuration of the dampers 44, the multiple mode hybrid heat exchanger 10 is operating in evaporative—adiabatic mode.

Figure 20:
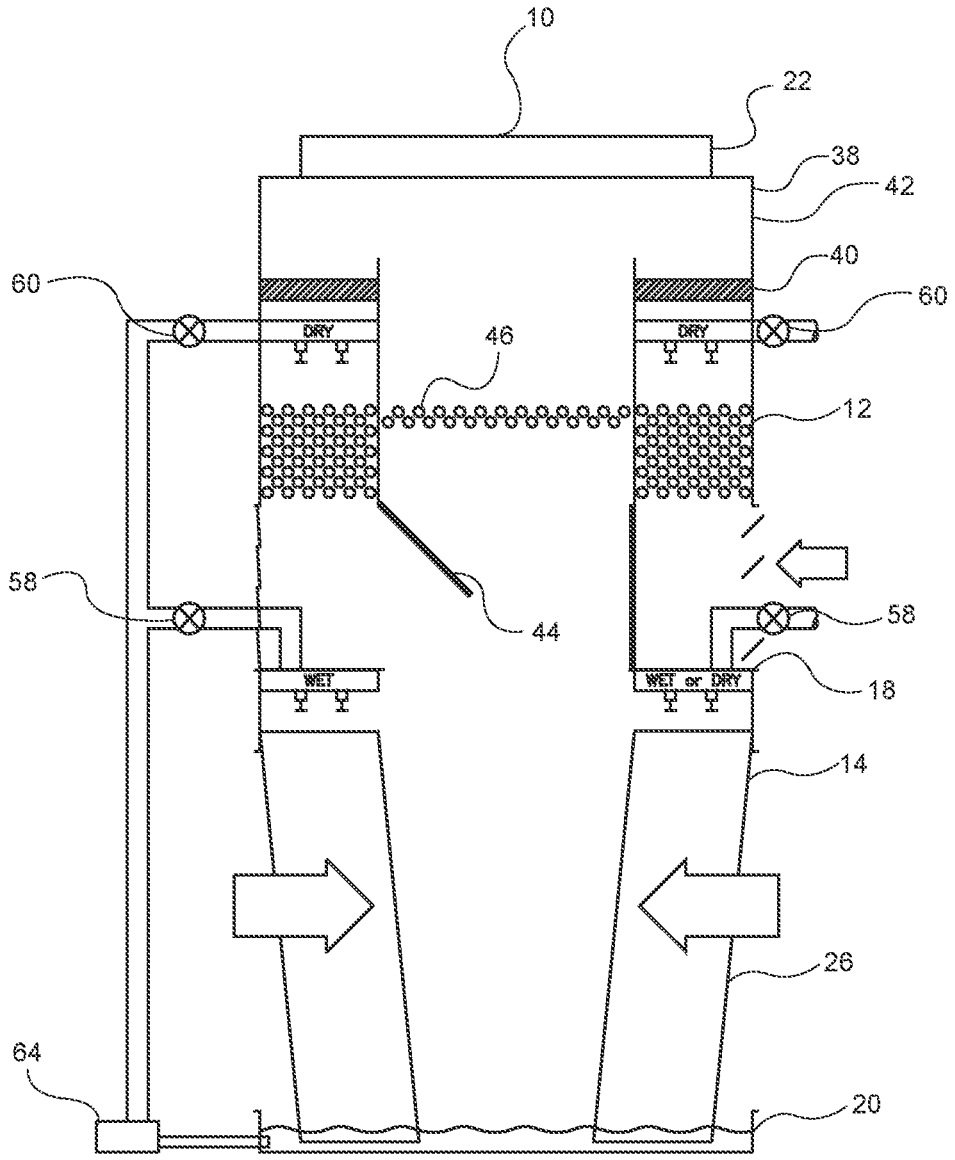
FIG. 20 is a cutaway view through the side of the multiple mode hybrid heat exchanger according to FIG. 14 in dry—adiabatic mode with partially closed internal dampers and partially open inlet louvers, with only the direct HE hydraulic valves activated.

FIG. 20 is a cutaway view through the side of the multiple mode hybrid heat exchanger 10 according to FIG. 14 in dry—adiabatic mode with partially closed internal dampers 44 and partially open inlet louvers 48. As shown in FIG. 20, with the dampers 44 rotated to partially close the vertical passage 30 up from the direct HE section 14 on a first side to allow some of the air passing through the direct heat exchanger 14 to be drawn through one side of the indirect HE section 12. On both sides, the spray system valves 60 are closed to prevent water from falling through the indirect HE 12. On the second side, the inlet louver 48 are open to allow air through the dry indirect HE 12. In addition, on the first side of the indirect HE section 12, the inlet louvers 48 may be closed to increase draw through the direct HE 14. In this configuration of the dampers 44. the multiple mode hybrid heat exchanger 10 is operating in adiabatic—dry mode.

Figure 21:
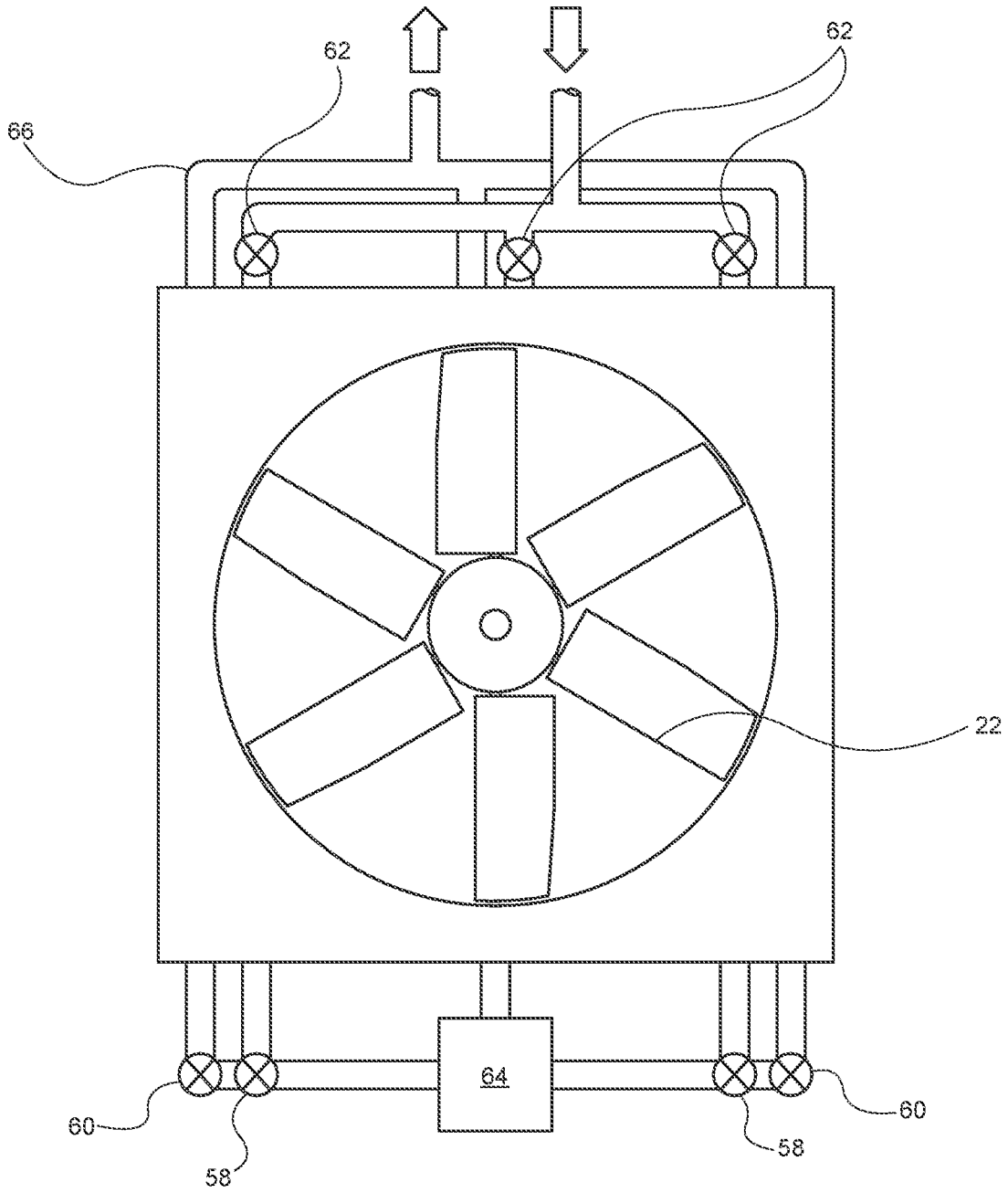
FIG. 21 is a plan view showing inlet and outlet piping, valves, and pump of the multiple mode hybrid heat exchanger according to FIG. 14.

FIG. 21 is a plan view showing inlet and outlet piping 66, hot water basin valves 58, spray system valves 60, heat exchanger valves 62, and recirculating pump 64 of the multiple mode hybrid heat exchanger 10 of FIG. 14. As shown in FIG. 21, each of the valves 58-62 may be operated independently and systems to each side of the multiple mode hybrid heat exchanger 10 may be operated independently from the other side. The piping diagram of FIG. 21 is similar to the piping diagram of FIG. 13 except that the piping diagram of FIG. 21 includes a third heat exchanger valve 62 and configured to selectively control a flow of water to the secondary indirect finned HE 46. It is an advantage of the embodiment shown in FIG. 21 that the multiple mode hybrid heat exchanger 10 is configured to perform a Pre-Cooling feature by circulating the process water through the secondary indirect finned HE 46.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A multiple mode hybrid heat exchanger apparatus, comprising:

a frame assembly comprising:
- a first end wall;
- a second end wall that opposes the first end wall;
- a first side wall that extends between the first end wall and the second end wall;
- a second side wall that opposes the first side wall that extends between the first end wall and the second end wall;

an indirect heat exchange section;

a spray system;

an intermediate distribution basin;

a direct heat exchange section disposed below the indirect heat exchange section;

a vertical passage defined by the frame assembly and the direct heat exchange section;

a lower air inlet defined by a plurality of openings in the direct heat exchange section, the lower air inlet configured to provide an inlet for air into the vertical passage;

a cold water collection basin disposed below the direct heat exchange section; and a fan to induce an airflow through the lower air inlet;

wherein the multiple mode hybrid heat exchanger apparatus is selectably configured to operate in an evaporative mode, a dry mode, and an adiabatic mode;

wherein the evaporative mode of operation includes:

activation of the spray system over the indirect heat exchange section;

air enters the vertical passage through the direct heat exchange section; and the airflow selectively passes through the indirect heat exchange section; and wherein the dry mode of operation includes:
- deactivation of the spray system;
- air enters the vertical passage through the direct heat exchange section; and
- the airflow then passes through the indirect heat exchange section; and wherein the adiabatic mode of operation includes:
- the spray system is deactivated and configured to bypass the indirect heat exchange section;
- the direct heat exchange section is configured to facilitate a passage of water therethrough;
- air enters the vertical passage through the direct heat exchange section, the air passing horizontally across a flow of the water to directly cool the water;
- the water is collected in the cold water collection basin; and
- the airflow then passes through the indirect heat exchange section.

2. The apparatus according to claim 1, wherein the indirect heat exchange section include an indirect Side A and an indirect Side B, wherein the direct heat exchange section includes a direct Side A and a direct Side B, and wherein one or more mode of operation further includes controlling the spray system to selectively and individually control the flow of the water to the indirect Side A, the indirect Side B, the direct Side A, and the direct Side B.

3. The apparatus according to claim 1, further comprising an upper air inlet disposed between the direct heat exchange section and the indirect heat exchange section and configured to facilitate the airflow through the indirect heat exchange section without passing through the direct heat exchange section.

4. The apparatus according to claim 3, further comprising an internal damper configured to modulate a proportion of air from the upper air inlet and the lower air inlet that passes through the indirect heat exchange section.

5. The apparatus according to claim 4, wherein the multiple mode hybrid heat exchanger apparatus is selectably configured to operate in an evaporative mode, the evaporative mode including:

controlling the internal damper to open the vertical passage and prevent air from the vertical passage from passing through the indirect heat exchange section.

6. The apparatus according to claim 5, wherein the multiple mode hybrid heat exchanger apparatus is selectably configured to operate in an evaporative mode, the evaporative mode including:

controlling the upper air inlet to open and facilitate the airflow through the indirect heat exchange section without passing through the direct heat exchange section.

7. The apparatus according to claim 4, wherein the adiabatic mode of operation further includes:

controlling the damper to close the vertical passage and cause air from the vertical passage to pass through the indirect heat exchange section.

8. The apparatus according to claim 7, wherein the adiabatic mode of operation further includes:

controlling the upper air inlet to close and facilitate the airflow through the indirect heat exchange section after passing through the direct heat exchange section.

9. The apparatus according to claim 4, wherein the dry mode of operation further includes:

controlling the internal damper to close the vertical passage and cause air from the vertical passage to pass through the indirect heat exchange section.

10. The apparatus according to claim 9, wherein the dry mode of operation further includes:

controlling the upper air inlet to open and facilitate the airflow through the indirect heat exchange section in combination with the air passing through the direct heat exchange section.

11. A multiple mode hybrid heat exchanger apparatus, comprising:

a frame assembly comprising:

a first end wall;

a second end wall that opposes the first end wall;

a first side wall that extends between the first end wall and the second end wall;

a second side wall that opposes the first side wall that extends between the first end wall and the second end wall;

a first indirect heat exchange section;

a spray system;

an intermediate distribution basin;

a direct heat exchange section disposed below the first indirect heat exchange section;

a vertical passage defined by the frame assembly and the direct heat exchange section;

a second indirect heat exchange section disposed in an upper portion of the vertical passage;

a lower air inlet defined by a plurality of openings in the direct heat exchange section, the lower air inlet configured to provide an inlet for air into the vertical passage;

a cold water collection basin disposed below the direct heat exchange section; and a fan to induce an airflow through the lower air inlet;

wherein the multiple mode hybrid heat exchanger apparatus is selectably configured to operate in an evaporative mode, a dry mode, and an adiabatic mode;

wherein the evaporative mode of operation includes:

activation of the spray system over the first indirect heat exchange section;

air enters the vertical passage through the direct heat exchange section; and the airflow selectively passes through the first indirect heat exchange section; and wherein the dry mode of operation includes:

deactivation of the spray system;

air enters the vertical passage through the direct heat exchange section; and the airflow then passes through the second indirect heat exchange section; and wherein the adiabatic mode of operation includes:

the spray system is deactivated and configured to bypass the first indirect heat exchange section;

the direct heat exchange section is configured to facilitate a passage of water therethrough;

air enters the vertical passage through the direct heat exchange section, the air passing horizontally across a flow of water to directly cool the water;

the water is collected in the cold water collection basin; and the airflow then passes through the first indirect heat exchange section and the second indirect heat exchange section.

12. The apparatus according to claim 11, further comprising an upper air inlet disposed between the direct heat exchange section and the first indirect heat exchange section and configured to facilitate the airflow through the first indirect heat exchange section without passing through the direct heat exchange section.

13. The apparatus according to claim 12, further comprising an internal damper configured to modulate a proportion of air from the upper air inlet and the lower air inlet that passes through the first indirect heat exchange section.

14. The apparatus according to claim 13, wherein the internal damper is further configured to modulate a proportion of air from the upper air inlet and the lower air inlet that passes through the second indirect heat exchange section.

15. The apparatus according to claim 14, wherein the multiple mode hybrid heat exchanger apparatus is selectably configured to operate in an evaporative mode, the evaporative mode including:

controlling the internal damper to open the vertical passage and prevent air from the vertical passage from passing through the first indirect heat exchange section; and wherein the internal damper facilitates the airflow through the second indirect heat exchange section.

16. The apparatus according to claim 15, wherein the multiple mode hybrid heat exchanger apparatus is selectably configured to operate in an evaporative mode, the evaporative mode including:

controlling the upper air inlet to open and facilitate the airflow through the first indirect heat exchange section without passing through the direct heat exchange section.

17. The apparatus according to claim 14, wherein the adiabatic mode of operation further includes:

controlling the internal damper to partially open the vertical passage and cause air from the vertical passage to pass through the first indirect heat exchange section; and wherein the internal damper allows airflow through the second indirect heat exchange section.

18. The apparatus according to claim 17, wherein the adiabatic mode of operation further includes:

controlling the upper air inlet to close and facilitate the airflow through the first indirect heat exchange section after passing through the direct heat exchange section.

19. The apparatus according to claim 14, wherein the dry mode of operation further includes:

controlling the internal damper to open the vertical passage and cause air from the vertical passage to pass through the second indirect heat exchange section.

20. The apparatus according to claim 19, wherein the dry mode of operation further includes:

controlling the upper air inlet to open and facilitate the airflow through the first indirect heat exchange section.

21. The apparatus according to claim 14, wherein the first indirect heat exchange section include an indirect Side A and an indirect Side B, wherein the direct heat exchange section includes a direct Side A and a direct Side B, and wherein one or more mode of operation further includes controlling spray system to selectively and individually control the flow of water to the indirect Side A, the indirect Side B, the direct Side A, and the direct Side B.

* * * * *